United States Patent [19]

Noro

[11] Patent Number: 4,943,956

[45] Date of Patent: Jul. 24, 1990

[54] DRIVING APPARATUS

[75] Inventor: Masao Noro, Hamamatsu, Japan

[73] Assignee: Yamaha Corporation, Hamamatsu, Japan

[21] Appl. No.: 340,553

[22] Filed: Apr. 19, 1989

[30] Foreign Application Priority Data

Apr. 25, 1988 [JP] Japan ..... 63-100215
Apr. 25, 1988 [JP] Japan ..... 63-100216
May 25, 1988 [JP] Japan ..... 63-125638

[51] Int. Cl.[5] ..... H04R 3/00

[52] U.S. Cl. ..... 367/137; 381/96; 333/217

[58] Field of Search ..... 367/137; 381/94, 96, 381/100, 111, 121, 98; 333/217

[56] References Cited

U.S. PATENT DOCUMENTS 4,220,040 9/1980 Noguchi et al. ..... 73/24

OTHER PUBLICATIONS

"Loudspeakers in Vented Boxes: Part I", A. N. Thiele, Journal of the Audio Engineering Society, May 1971, vol. 19, No. 5, pp. 382–392.

"Loudspeakers in Vented Boxes: Part II", A. N. Thiele, Journal of the Audio Engineering Society, Jun. 1971, vol. 19, No. 6, pp. 471–483.

*Primary Examiner*—Thomas H. Tarcza
*Assistant Examiner*—Daniel T. Piholic
*Attorney, Agent, or Firm*—Spensley Horn Jubas & Lubitz

[57] ABSTRACT

A driving apparatus for electrically driving a vibrator constituting an acoustic apparatus, wherein the output impedance of the driving apparatus is negative at least one frequency associated with the output sound pressure of the acoustic apparatus among resonance frequencies when the acoustic apparatus is viewed from a terminal for driving the vibrator, and the ratio of the output impedance to the internal impedance inherent in the vibrator never becomes constant over all the acoustic reproduction range of the acoustic apparatus. Then, it is possible to eliminate mutual dependency between resonance systems having the resonance frequencies, design of the resonance systems become easy, and improved performance of sound radiation can be expected.

19 Claims, 23 Drawing Sheets

DRIVING APPARATUS

BACKGROUND OF THE INVENTION

1. Field of the Invention

The present invention relates to an apparatus for driving a vibrator constituting an acoustic apparatus and, more particularly, to a driving apparatus which has an output impedance which appropriately changes in accordance with a frequency, and can cause an acoustic apparatus equivalent to a conventional one to radiate an acoustic wave having better frequency characteristics or sound quality than those of the conventional apparatus or can cause an acoustic apparatus using a conventional compact cabinet to radiate equivalent or better frequency characteristics or sound quality to or than those of the conventional apparatus.

2. Description of the Prior Art

Various speaker systems are known as a conventional acoustic apparatus.

As a driving apparatus for driving a speaker unit constituting such a speaker system, a power amplifier whose output impedance is essentially 0 is used.

FIGS. 41A and 41B are respectively a perspective view and a sectional view showing an arrangement of a bass-reflex type speaker system as one of conventional speaker systems. In the speaker system shown in FIGS. 41A and 41B, a hole is formed in the front surface of a cabinet 1, and a vibrator (speaker unit) 4 consisting of a diaphragm 2 and a dynamic electro-acoustic transducer 3 is mounted in the hole. A resonance port 8 having an opening 6 and a sound path 7 is arranged below the vibrator 4. The cabinet 1 and the port 8 constitute a Helmholtz resonator.

FIG. 42 shows a simplified electrically equivalent circuit when the bass-reflex speaker system shown in FIGS. 41A and 41B is driven at a constant voltage by a power amplifier whose output impedance is 0. In FIG. 42, reference symbol $E_{VC}$ denotes an output voltage of a constant voltage source as a power amplifier; $R_{VC}$, a voice coil resistance of the speaker unit 4; $L_O$ and $C_O$, an equivalent capacitance (or an equivalent mass) and an equivalent inductance (or a reciprocal number of an equivalent stiffness) of a motional impedance generated when a voice coil of the speaker unit 4 is moved; $L_C$, an equivalent inductance (or a reciprocal number of an equivalent stiffness) of the cabinet 1; and $C_P$, an equivalent capacitance (or an equivalent mass) of the port 8.

FIG. 43 shows electrical impedance-frequency characteristics of the circuit shown in FIG. 42. In FIG. 43, reference symbol $f_1$ denotes a resonance frequency of a first resonance system (to be referred to as a unit resonance system hereinafter) essentially formed by the motional impedances $L_O$ and $C_O$ of the speaker unit 4 and the equivalent stiffness $1/L_C$ of the cabinet 1; $f_2$, a resonance frequency of a second resonance system (to be referred to as a port resonance system hereinafter) formed by the equivalent mass $C_P$ of the port 8 and the equivalent stiffness $1/L_C$ of the cabinet 1; and $f_3$, a resonance frequency of a third resonance system essentially formed by the motional impedances $L_O$ and $C_O$ of the speaker unit 4 and the equivalent mass $C_P$ of the port 8.

Of these resonance frequencies, the frequency $f_3$ is not associated with a sound pressure However, the resonance frequencies $f_1$ and $f_2$ directly influence a sound pressure. A Q value $Q_1$ of the unit resonance system at the resonance frequency $f_1$ and a Q value $Q_2$ of the port resonance system at the resonance frequency $f_2$ largely influence frequency characteristics and sound quality of an output sound pressure When the bass-reflex speaker system is driven at a constant voltage, if the resonance frequency $f_2$ of the port resonance system is decreased, the Q value $Q_1$ of the unit resonance system is increased, and the Q value $Q_2$ of the port resonance system is decreased. In this manner, the resonance frequencies and Q values have mutual dependencies. For this reason, in order to obtain flat frequency characteristics of an output sound pressure, the unit and port resonance systems must be accurately matched with each other, such that the Q value $Q_1$ of the unit resonance system is set to be $Q_1=\sqrt{3}$, the resonance frequency $f_2$ of the port resonance system is set to be $f_2=f_1/\sqrt{3}$, and so on, thus restricting a design margin.

If the cabinet is rendered compact, the equivalent stiffness $1/L_C$ of the cabinet is increased, and the equivalent inductance $L_C$ is decreased. As a result, the Q value $Q_1$ is increased, and the Q value $Q_2$ is decreased. For this reason, if a conventional constant voltage driving method is employed without any modification, a normal operation of the bass-reflex speaker system is difficult to achieve. Therefore, it is difficult to make the cabinet of the bass-reflex speaker system compact without impairing frequency characteristics of an output sound pressure and sound quality.

FIG. 44 shows a negative impedance generating circuit for which an application is filed as U.S. Patent Ser. No. 07/286,869 by the present applicant. When the negative impedance generating circuit in FIG. 44 is used as a driving apparatus for the equivalent circuit shown in FIG. 42 and an output impedance is caused to include a negative resistance $-R_O$, the voice coil resistance $R_{VC}$ is reduced or invalidated. Thus, the value $Q_1$ can be decreased and the value $Q_2$ can be increased as compared to a case wherein the speaker system is driven at a constant voltage by the power amplifier whose output impedance is 0. Thus, the bass-reflex speaker system can be effectively rendered compact.

However, in this case, if the negative resistance $-R_O$ is constant, since the values $Q_1$ and $Q_2$ cannot be independently set, the speaker unit or the cabinet suffers from a certain limitation when the values $Q_1$ and $Q_2$ are set to be desired values.

FIG. 45 shows a second example of a conventional speaker system. This acoustic apparatus is the same as a speaker system with a port disclosed in Japanese Patent Laid-Open (Kokai) Sho No. 60-98793. An internal space of a known cabinet 21 having a rectangular section is divided into two chambers **21*a* and 21*b* by a partition wall 22. Opening ports 23*a* and 23*b* are respectively provided to the outer walls of the chambers 21*a* and 21*b*. The chamber 21*a* and the opening port 23*a*, and the chamber 21*b* and the opening port 23*b* respectively form two Helmholtz resonators. The resonance frequencies of the respective Helmholtz resonators are set to be $f_4$ and $f_2$ ($f_4<f_2$). An opening 22*a* is formed in the partition wall 22. A vibrator (dynamic speaker unit) 25 is mounted in the opening 22*a*. A diaphragm 26 of the vibrator 25 is mounted to close the opening 22*a*, the front surface of the diaphragm 26 faces the chamber 21*a*, and its rear surface faces the chamber 21*b***.

FIG. 46 shows an electrically equivalent circuit when the vibrator 25 of the apparatus shown in FIG. 45 is driven at a constant voltage. In FIG. 46, a parallel resonance circuit $Z_1$ is formed by the equivalent motional impedance of the vibrator 25. In this circuit, reference symbol $r_O$ denotes an equivalent resistance of a vibration system; $L_O$, an equivalent inductance (or a reciprocal number of an equivalent stiffness) of the vibration system; and $C_O$, an equivalent capacitance (or an equivalent mass) of the vibration system. A series resonance circuit $Z_4$ is formed by the equivalent motional impedance of the first Helmholtz resonator constituted by the chamber 21*a* and the opening port 23*a*. In this circuit, reference symbol $r_{1a}$ denotes an equivalent resistance of the chamber 21*a* as a cavity of the resonator; $L_{1a}$, an equivalent inductance (or a reciprocal number of an equivalent stiffness) of this cavity; $r_{1p}$, an equivalent resistance of the opening port 23*a*; and $C_{1p}$, an equivalent capacitance (or an equivalent mass) of the opening port 23*a*. A series resonance circuit $Z_2$ is formed by the equivalent motional impedance of the second Helmholtz resonator constituted by the chamber 21*b* and the opening port 23*b*. In this circuit, reference symbol $r_{2a}$ denotes an equivalent resistance of the chamber 21*b* as a cavity of the resonator; $L_{2a}$, an equivalent inductance (or a reciprocal number of an equivalent stiffness) of this cavity; $r_{2p}$, an equivalent resistance of the opening port 23*b*; and $C_{2p}$, an equivalent capacitance (or an equivalent mass) of the opening port 23*b*. In FIG. 46, reference symbol $Z_{VC}$ denotes an internal impedance of the vibrator 25. When the vibrator 25 is a dynamic direct radiation speaker, the internal impedance mainly serves as the resistance $R_{VC}$ of the voice coil, and includes a slight inductance. Reference symbol $E_{VC}$ denotes a constant voltage source as a driving source whose output impedance is 0. Note that the equivalent resistances $r_{1a}$, $r_{1p}$, $r_{2a}$, and $r_{2p}$ have small values which can be ignored as compared to the resistance $R_{VC}$ of the voice coil.

FIG. 47 shows electrical impedance characteristics of the system shown in FIG. 45. In the system shown in FIG. 45, five resonance points $f_1$ to $f_5$ are generated by one parallel resonance circuit $Z_l$ and two series resonance circuits $Z_2$ and $Z_4$. Of these resonance points $f_1$ to $f_5$, the resonance frequency $f_2$ by the series resonance circuit $Z_2$ and the resonance frequency $f_4$ by the series resonance circuit $Z_4$ are mainly associated with the output sound pressure.

In the speaker system shown in FIG. 45, it is ideal that the output sound pressures from the opening ports 23*a* and 23*b* become equal to each other at the frequencies $f_2$ and $f_4$, as indicated by solid curves in FIG. 48, and are mixed to generate a flat total sound pressure between the frequencies $f_2$ and $f_4$, as indicated by a dotted line in FIG. 48. However, in order to achieve this, Q values must be set to be appropriate values For example, a Q value $Q_4$ at the frequency $f_4$ must be set to be higher than a Q value $Q_2$ at the frequency $f_2$.

In the conventional constant voltage driving method, a damping resistance determining Q values at the frequencies $f_2$ and $f_4$ is commonly $R_{VC}$. Therefore, in order to adjust these Q values to appropriate values, the volumes ($L_{1a}$ and $L_{2a}$) of the chambers 21*a* and 21*b* and the masses ($C_{1p}$ and $C_{2p}$) in the ports can only be adjusted.

The speaker system with the arrangement shown in FIG. 45 (to be referred to as a double bass-reflex system hereinafter) is originally adopted to efficiently reproduce a narrow band as compared to normal speaker systems, and achieves this by utilizing two resonance states.

Note that $f_2=80$ Hz and $f_4=40$ Hz, and a sub-woofer having flat characteristics in a frequency range of 40 Hz to 80 Hz is assumed.

An average energy spectrum of a music is attenuated at two sides to have 200 Hz as the center, as shown in FIG. 49. Thus, in the energy spectrum of a music signal applied to this sub-woofer, a component $E(f_2)$ of the frequency $f_2$ is generally larger than a component $E(f_4)$ of the frequency $f_4$. In order to achieve high efficiency, a resonance at the frequency $f_2$ or higher must be valid. An acoustic resonance tends to have a high Q value at a high frequency rather than a low frequency if a volume remains the same, and a sound pressure is proportional to an acceleration of an air vibration. Therefore, since $E(f_2)>E(f_4)$, the output sound pressure at the frequency $f_2$ becomes higher than that at the frequency $f_4$ if the resonance Q value is left unchanged.

Therefore, it is easier to validate a resonance at the frequency $f_2$ than at the frequency $f_4$, and is preferable in terms of efficiency. However, the fact that the sound pressure at the frequency $f_4$ and the output sound pressure at the frequency $f_2$ are almost equal to each other and a band from $f_2$ to $f_4$ is almost flat is an original condition for the speaker system. Therefore, if the resonance at only the frequency $f_2$ is valid, the original condition for the speaker system cannot be satisfied, and flat frequency characteristics cannot be obtained. In order to obtain flat frequency characteristics, unless a resonance at the frequency $f_4$ is performed under a more effective condition than that at the frequency $f_2$, the sound pressure at the frequency $f_4$ which tends to be low is decreased.

For these reasons, in an actual double bass-reflex system, the sound pressure at the frequency $f_4$ is increased by establishing (the volume of the cavity 21*a*)>>(the volume of the cavity 21*b*). The volume of the cavity 21*a* and the dimensions of the opening port 23*a* are designed to have a relatively small Q value at the frequency $f_2$ so that the sound pressure at the frequency $f_2$ matches with that at the frequency $f_4$. This is to satisfy a frequency characteristic condition which is the prime importance as the performance of the speaker system by all means. Of course, such a speaker system can have improved efficiency as compared to a speaker system with no port. However, since the sound pressure by the resonance at the frequency $f_2$ is caused to match with that at the frequency $f_4$, efficiency at the frequency $f_2$ is inevitably decreased. The dimensions of the speaker system are almost determined by a design not for the frequency $f_2$ but for the frequency $f_4$. Therefore, in view of energy, the dimensions of the system are determined on the basis of the frequency $f_4$ at which an energy less than that at the frequency $f_2$ is applied, and the efficiency at the frequency $f_2$ must be suppressed to match with the sound pressure at the frequency $f_4$.

In the acoustic apparatus shown in FIG. 45 for driving the double bass-reflex speaker system at a constant voltage, since the dimensions of the cabinet are related to the Q values at the resonance frequencies $f_2$ and $f_4$, a design margin is small, and it is difficult to make the cabinet compact.

FIG. 50 shows an electrically equivalent circuit when a dynamic speaker unit is mounted on an infinite baffle and is driven at a constant voltage by a power amplifier whose output impedance is 0. In FIG. 50, reference symbol $E_{VC}$ denotes a constant voltage source as the power amplifier and its output voltage; and $R_{VC}$ and $L_{VC}$, a resistance and an inductance of a voice coil of the speaker unit, respectively. Reference symbols $L_O$ and $C_O$ denote an equivalent capacitance and inductance of a motional impedance generated when the voice coil of the speaker unit is moved; and $R_O$, a mechanical damping resistance. In general, $R_O >> R_{VC}$. $R_{VC}$ and $L_{VC}$ are an electrical resistance and inductance of the voice coil itself, and are non-motional impedances.

The non-motional impedance $Z_{VC}$ is given by:

$$Z_{VC}=R_{VC}+j\omega L_{VC}$$

A motional impedance $Z_M$ is given by:

$$Z_M = \frac{j\omega L_O R_O}{(1 - \omega^2 L_O C_O)R_O + j\omega L_O}$$

where $\omega$ is the angular frequency. If the frequency is represented by f, $\omega=2\pi f$.

FIG. 51 shows electrical impedance-frequency characteristics of the circuit shown in FIG. 50. In FIG. 50, an increase in impedance in a high-frequency range is caused by the inductance $L_{VC}$ of the voice coil. As described above, the inductance $L_{VC}$ is an electrical inductance of the voice coil itself, and is not a motional impedance. Therefore, when the voice coil is placed in a magnetic circuit formed by a magnetic member and is moved therein in response to a signal, the inductance is modulated by this signal. In particular, when a high-frequency signal is input simultaneously with a low-frequency signal having a large amplitude, the inductance $L_{VC}$ is largely varied by the low-frequency signal, and a current of the high-frequency signal is modulated to generate a so-called IM distortion (intermodulation distortion).

A frequency $f_O$ is a resonance frequency caused by the motional impedance $Z_M$, and is given by:

$$f_O = \frac{1}{2\pi\sqrt{L_O C_O}}$$

When the negative impedance generating circuit shown in FIG. 44 is used as the driving apparatus $E_{VC}$ in the equivalent circuit shown in FIG. 50 and the circuit is driven while the output impedance is caused to include the negative resistance $-R_O$ (to be referred to as negative-resistance driving hereinafter), the voice coil resistance $R_{VC}$ is equivalently reduced by the negative resistance $-R_O$.

In the dynamic speaker unit as shown in the equivalent circuit of FIG. 50, the motional impedance $Z_M$ in a low-frequency range near the resonance frequency $f_O$ is very large, and the impedance $j\omega L_{VC}$ of the inductance $L_{VC}$ is very small. For this reason, the impedance $j\omega L_{VC}$ can be ignored with respect to the motional impedance $Z_M$. If $R_{VC}-R_O=0$, the output voltage of the constant voltage source $E_{VC}$ is substantially directly applied to the vibration system (motional impedance $Z_M$). Therefore, the Q value of the parallel resonance circuit of $L_O$ and $C_O$ constituting the vibration system becomes 0, and the operation of the vibration system becomes a constant-speed operation, thereby increasing a driving force and a damping force. Note that if $R_{VC}-R_O>0$, since the resistance $R_{VC}$ is equivalently decreased, an intermediate state between a case wherein the speaker unit is driven at a constant voltage and a case wherein the vibration system is operated at a constant speed while $R_{VC}-R_O=0$ can be established. The driving force and damping force of the vibration system can be increased as compared to constant-voltage driving.

However, at a frequency in a high-frequency range separated from the resonance frequency $f_O$, the impedance $j\omega L_{VC}$ the inductance $L_{VC}$ increased, and the impedance $1/j\omega C_O$ of the equivalent capacitance $C_O$ is decreased so that the motional impedance $Z_M$ is decreased. Thus, the driving current is determined by the non-motional impedance $Z_{VC}$ consisting of the resistance $R_{VC}$ of the voice coil and the inductance $L_{VC}$. For this reason, when the voice coil resistance $R_{VC}$ is decreased by the negative resistance driving, a driving current in a high-frequency range tends to be influenced by the voice coil inductance $L_{VC}$. Therefore, an adverse influence on distortion characteristics of the speaker unit due to the inductance $L_{VC}$ is enhanced as compared to the normal constant-voltage driving method.

In practice, the above-mentioned infinite baffle is not used, and the speaker unit is generally mounted on a cabinet. When the speaker unit is mounted on a closed baffle (cabinet), the motional impedance $Z_M$ is equivalently connected in parallel with an equivalent inductance $L_C$ of the closed cabinet A resonance frequency $f_{OC}$ and a motional impedance $Z_{MC}$ in such a practical use state are respectively given by:

$$f_{OC} = \frac{1}{2\pi}\cdot\sqrt{\frac{L_O + L_C}{C_O L_O L_C}}$$

$$Z_{MC} = \frac{1}{1/Z_M + 1/L_C}$$

When such a closed baffle is used, if the above-mentioned $f_O$ is replaced with $f_{OC}$ and $Z_M$ is replaced with $Z_{MC}$, the above description made for a case wherein the infinite baffle is used can be applied.

The bass-reflex speaker system shown in FIG. 41 in which the speaker unit is mounted on the cabinet having the resonance port, causes three resonance frequencies, i.e., the first resonance frequency $f_1$ by a parallel resonance of the equivalent inductance $L_C$ of the cabinet and the motional impedance $Z_M$ ($L_O$ and $C_O$), the second resonance frequency $f_2$ by a series resonance of the equivalent capacitance $C_P$ of the resonance port and the equivalent inductance $L_C$ of the cabinet, and the third resonance frequency $f_3$ by a parallel resonance of the motional impedance $Z_M$ and the equivalent capacitance $C_P$ of the resonance port, as described above.

Of these resonance frequencies, the resonance frequency $f_1$ directly influences a sound pressure, and Q values at the resonance frequencies $f_1$ and $f_2$ largely influence frequency characteristics of the output sound pressure and sound quality. In this bass-reflex speaker system, when negative resistance driving is performed, the Q value at the frequency $f_1$ is decreased and the Q value at the frequency $f_2$ is increased as compared to those in the constant-voltage driving. Thus, the damping force and driving force at the frequency $f_1$ are increased, and a matching state between the speaker unit and the cabinet can be adjusted by the negative resistance $-R_O$, thus increasing a design margin and allowing lower bass sound reproduction However, at a frequency in a high-frequency range separated from these resonance frequencies $f_1$ and $f_2$, a driving current tends to be influenced by the inductance $L_{VC}$. Therefore, an adverse influence on acoustic characteristics, e.g., distortion characteristics caused by the inductance $L_{VC}$ is promoted as compared to the normal constant-voltage driving method.

SUMMARY OF THE INVENTION

The present invention has been made in consideration of the conventional problems, and has as its first object to provide a driving apparatus for driving a vibrator of an acoustic apparatus in which the vibrator is disposed on a resonator having a closed cavity (e.g., a cabinet) and acoustic mass means (e.g., a resonance opening) for causing the cavity to acoustically communicate with an external area, wherein Q values at a first frequency by the vibrator and a stiffness of the cavity and at a second frequency by the stiffness of the cavity and the mass means can be independently set, and a size of a system including the acoustic apparatus and the driving apparatus of the present invention can be reduced and performance of the system can be improved, in such a manner that the acoustic apparatus can be rendered compact, and a damping force can be increased.

It is a second object of the present invention to provide a driving apparatus for driving an acoustic apparatus which drives a plurality of resonators having different resonance frequencies by one vibrator, wherein the acoustic apparatus can be made compact and a design margin can be increased.

It is a third object of the present invention to provide a driving apparatus which can eliminate an adverse influence on sound quality caused by a non-motional impedance of an electro-acoustic transducer (vibrator) to a level equivalent to or lower than that achieved by a normal constant-voltage driving method while improving a driving force (sound pressure) and a damping force near a resonance frequency associated with a sound pressure of the transducer.

In order to achieve the above objects, according to a first aspect of the present invention, there is provided a driving apparatus for driving a vibrator of an acoustic apparatus in which the vibrator is disposed in a cavity having acoustic mass means, characterized in that at least one of output impedances at a first resonance frequency by the vibrator and a stiffness of the cavity and at a second resonance frequency by the stiffness of the cavity and the mass means becomes a negative impedance, and the output impedances have different values.

The equivalent circuit shown in FIG. 42 will be again exemplified below When the output impedance of the driving apparatus is a negative impedance $-Z_O$ and can completely invalidate an impedance $Z_V$(e.g., $R_{VC}$ in FIG. 42) inherent in the vibrator, i.e., when $Z_V-Z_O=0$ ($R_{VC}-R_O=0$ in FIG. 42), the parallel resonance circuit as a unit resonance system constituted by the equivalent inductance $L_O$ and the equivalent capacitance $C_O$ of the speaker unit is short-circuited through the constant voltage source $E_{VC}$ as the driving apparatus. Therefore, the value $Q_1$ becomes 0, and this circuit is essentially not resonated. In other words, the unit resonance system resonance circuit is driven by the driving apparatus $E_{VC}$ in a perfectly damped state. The series resonance circuit (port resonance system) at the resonance side constituted by the equivalent stiffness $1/L_C$ of the cavity and the equivalent mass $C_P$ of the mass means is short-circuited through the driving apparatus $E_{VC}$. However, since this resonance system is a series resonance circuit, a theoretical value $Q_2$ is $\infty$ if the acoustically equivalent resistance of the cavity and the mass means is ignored. In this case, the unit resonance system and the port resonance system are independently driven by the driving apparatus $E_{VC}$, and have no mutual dependency therebetween. Therefore, the resonance frequencies $f_1$ and $f_2$ and the Q values $Q_1$ and $Q_2$ can be set independently of each other. When $R_{VC}-R_O>0$ or when the acoustically equivalent resistance of the cabinet and the resonance port (or a resonance opening) cannot be ignored, the values $Q_1$ and $Q_2$ take intermediate values between the 0 and $\infty$ mentioned above and those by the conventional driving method in which the output impedance of the driving apparatus is 0. When the output impedance of the driving apparatus is a positive value, the value $Q_1$ is increased and the value $Q_2$ is decreased as the output impedance value is increased.

Assuming a bass-reflex speaker system in which a resonance frequency by a cabinet and a port is set to be low while using a compact cabinet, it has a larger value $Q_1$ and a smaller value $Q_2$ than those of a bass-reflex speaker system according to a standard design. When this speaker system is driven by the negative resistance $-R_O$ ($R_{VC}-R_O\geqq 0$), the value $Q_1$ is decreased and the value $Q_2$ is increased as the absolute value of the negative resistance $-R_O$ is increased. FIG. 1 shows the relationship among the negative resistance $-R_O$, $Q_1$, and $Q_2$.

In FIG. 1, when $R_O=0$, a conventional, general constant-voltage drive state is established. When $-R_O$ is decreased to be smaller than 0 and to be approximate to $-R_{VC}$, the value $Q_1$, is almost linearly, decreased toward 0. On the contrary, the value $Q_2$ is increased but does not reach $\infty$, and approaches a value determined by the acoustic resistance of the cabinet and the port.

Therefore, the values $Q_1$ and $Q_2$ may become desired values at a given $-R_O$. However, as shown in FIG. 1, the $-R_O$ value ($-R_O=-R_A$) yielding a desired $Q_1$ (=A) may often be different from the $-R_O$ value ($-R_O=-R_B$) yielding a desired $Q_2$ (=B).

According to the first aspect of the present invention, in this case, the output impedance of the driving apparatus (to be referred to as a driving impedance hereinafter) at the frequency $f_1$ is set to be $-R_A$, and the driving impedance at the frequency $f_2$ is set to be $-R_B$, thereby obtaining the desired values $Q_1$ and $Q_2$.

In some cabinet designs, both the values $Q_1$ and $Q_2$ are increased, and must be decreased. In this case, according to the present invention, as shown in FIG. 2, the driving impedance $Z_1$ at the frequency $f_1$ is set to be negative ($-R_A$), and the driving impedance $Z_2$ at the frequency $f_2$ is set to be positive ($R_B$). In contrast to this, when both the values $Q_1$ and $Q_2$ are to be increased, according to the present invention, the driving impedance $Z_1$ at the frequency $f_1$ is set to be positive ($R_A$), and the driving impedance $Z_2$ at the frequency $f_2$ is set to be negative ($-R_B$). Note that since another resonance frequency $f_3$ is not associated with an output sound pressure, the driving impedance value at this frequency $f_3$ is not particularly limited. The driving impedance $Z_3$ at the frequency $f_3$ is preferably set to satisfy $Z_3<0$ so as to suppress a wasteful movement of the diaphragm of the vibrator.

As described above, according to the first aspect of the present invention, when the vibrator of the acoustic apparatus in which the vibrator is disposed in the resonator constituted by the cavity and the acoustic mass means, the driving impedance $Z_1$ at the first resonance frequency $f_1$ determined by the vibrator and the cavity and the driving impedance $Z_2$ at the second resonance frequency $f_2$ determined by the cavity and the mass means are set to be negative values and to satisfy $Z_1 \neq Z_2$, or one of the $Z_1$ and $Z_2$ is set to be positive or 0 and the other is set to be negative, so that the values $Q_1$ and $Q_2$ can be independently set. Thus, the acoustic apparatus having the resonator, e.g., a speaker system can be designed regardless of limitations on a conventional bass-reflex type system. For example, the cabinet can be rendered compact so as to achieve a compact system without impairing the sound pressure and sound quality. Since appropriate Q values can be obtained at the resonance frequencies $f_1$ and $f_2$, a design margin can be increased compared to a system having a constant negative output impedance ($-Z_O$). Depending on conditions, improved performance can be expected compared to a system having a constant $-Z_O$. When the driving impedance $Z_1$ at the first resonance frequency $f_1$ is set to be a negative value so as to decrease the value $Q_1$, the speaker system can be driven while the unit resonance system is damped.

According to a second aspect of the present invention, there is provided a driving apparatus for driving a vibrator of an acoustic apparatus in which a plurality of resonators having different resonance frequencies are driven by the vibrator and sound pressure outputs of the resonators are mixed to be radiated as an acoustic wave, characterized in that the vibrator is driven by the driving apparatus which includes a negative impedance in an output impedance at least at one of resonance frequencies associated with a sound pressure among a plurality of resonance frequencies formed by a combination of motional impedance elements of the vibrator and the resonators.

The driving apparatus according to the second aspect of the present invention negative-impedance drives the vibrator at least at one frequency of resonance frequencies associated with a sound pressure of those formed by the plurality of motional impedances. Therefore, a non-motional impedance of the vibrator at that resonance frequency is eliminated or invalidated. For example, when the output impedance of the driving apparatus is the negative resistance $-R_O$ ($R_{VC}-R_O=0$) in the entire reproduction range of the acoustic apparatus shown in FIG. 45, i.e., when the resistance $R_{VC}$ is short-circuited in the equivalent circuit shown in FIG. 46, the resonance circuits $Z_1$, $Z_2$, and $Z_4$ are equivalently directly connected to the constant voltage source $E_{VC}$ having an AC impedance 0, and their two ends are short-circuited in an AC manner. Thus, the parallel resonance circuit $Z_1$ has a resonance Q value of 0, and the series resonance circuits $Z_2$ and $Z_4$ theoretically have Q values of $\infty$ if the acoustically equivalent resistances $r_{1a}$, $r_{1p}$, $r_{2a}$, and $r_{2p}$ are ignored. In this case, the resonance circuits $Z_2$ and $Z_4$ are connected through the zero impedance, and have no mutual dependency. Therefore, the resonance frequencies $f_4$ and $f_2$ and the Q values $Q_4$ and $Q_2$ can be independently set. Note that when $R_{VC}-R_O>0$, or when the acoustically equivalent resistances $r_{1a}$, $r_{1p}$, $r_{2a}$, and $r_{2p}$ of the cavities and the resonance opening ports cannot be ignored, the values $Q_4$ and $Q_2$ take intermediate values between $\infty$ and those in a case of the conventional constant-voltage driving method in which the output impedance of the driving apparatus is 0, as in the first aspect. When the output impedance of the driving apparatus is a positive value, the values $Q_2$ and $Q_4$ are decreased as the output impedance value is increased.

In this manner, according to the second aspect of the present invention, the output impedance of the driving apparatus is appropriately set at least at a resonance frequency associated with a sound pressure, so that Q values at the corresponding resonance frequencies can be appropriately set to obtain appropriate sound pressure characteristics. Therefore, the dimensions of the cavity (cabinet) of the acoustic apparatus can be relatively freely designed, thus increasing a design margin and making the cavity compact.

When a driving apparatus according to a third aspect of the present invention drives an electro-acoustic transducer (vibrator), it drives, by a negative impedance, this transducer near at least a resonance frequency associated with a sound pressure of those in an actual use state of this transducer, and drives, by a zero positive impedance, the transducer in a range wherein the influence of a non-motional impedance of the transducer on sound quality cannot be ignored.

According to the driving apparatus of the third aspect, since the electro-acoustic transducer is driven by the negative impedance near at least a resonance frequency associated with a sound pressure of those in an actual use state of the transducer, the non-motional impedance of the transducer is eliminated or invalidated. Therefore, a Q value at a resonance frequency $f_C$, $f_{OC}$, or $f_1$ of a vibration system of the transducer equivalently constituting a parallel resonance system is decreased, and a driving force and damping force near the resonance frequency can be improved. More specifically, the vibration system is operated at a constant speed by the negative impedance driving, and the driving force and damping force of the speaker unit are improved.

Note that the Q value is increased and an output sound pressure from the resonance port is increased near the resonance frequency $f_2$ by the resonance port and the cabinet of the bass-reflex speaker system equivalently constituting a series resonance system.

Since the transducer is driven by the zero or positive impedance at a frequency separated from these resonance frequencies, the transducer is driven at a constant voltage or current. More specifically, the driving current is determined by the output impedance and a linear component of the non-motional impedance of the speaker unit. An acoustic distortion caused by the influence of a non-linear component of the non-motional impedance which remains when the non-motional impedance is eliminated or invalidated by the negative impedance driving is suppressed by the zero-impedance driving to a level equivalent to that by the conventional constant-voltage driving, and can be decreased by the positive-impedance driving to a level lower than that by the constant-voltage driving.

In this manner, according to the third aspect of the present invention, the electro-acoustic transducer is driven by the negative impedance near at least a resonance frequency associated with a sound pressure of those in an actual use state of the transducer, so that advantages of the negative-impedance driving, such as improvement of the damping force, driving force, and a design margin, can be enhanced At the same time, the transducer is driven by the zero or positive impedance in a range wherein the influence of the non-motional impedance of the transducer given to sound quality cannot be ignored, so that the adverse influence of the non-motional impedance can be prevented or eliminated.

DETAILED DESCRIPTION OF THE PREFERRED EMBODIMENTS

Preferred embodiments of the present invention will now be described with reference to the accompanying drawings.

(First Embodiment)

Figure 3:
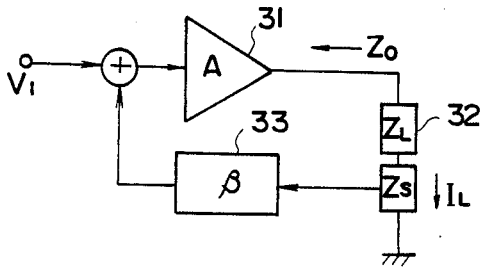
FIG. 3 is a circuit diagram for explaining a basic arrangement of a driving apparatus according to a first embodiment of the present invention.

FIG. 3 shows a basic circuit arrangement of a driving apparatus according to a first embodiment of the present invention. In the driving apparatus in FIG. 3, an output from an amplifier 31 having a gain A is supplied to a load $Z_L$ of a speaker 32. A current $I_L$ flowing through the load $Z_L$ is detected, and is positively fed back to the amplifier 31 through a feedback circuit 33 having a transmission gain $\beta$. With this arrangement, an output impedance $Z_O$ of the driving apparatus is given by $Z_O=Z_S(1-A\beta)$ *where* $Z_S$ is the impedance of a sensor for detecting the current I. From this equation, if $A\beta>1$, $Z_O$ becomes an open-stable negative impedance.

An application example corresponding to this circuit is disclosed in Japanese Pat. Publication Sho No. 59-51771.

Figure 4:
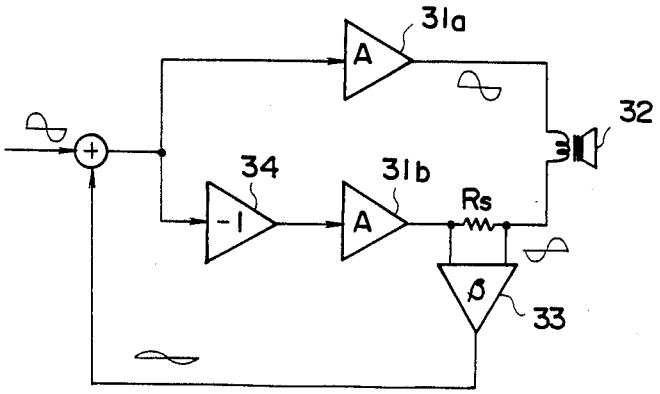
FIG. 4 is a circuit diagram showing a modification of FIG. 3.

Current detection can be performed at a non-ground side of the speaker 32. An application example of this circuit is disclosed in, e.g., Japanese Pat. Publication Sho No. 54-33704. FIG. 4 shows a BTL connection, and can be easily applied to the circuit shown in FIG. 3. In FIG. 4, reference numeral 34 denotes an inverter.

Figure 5:
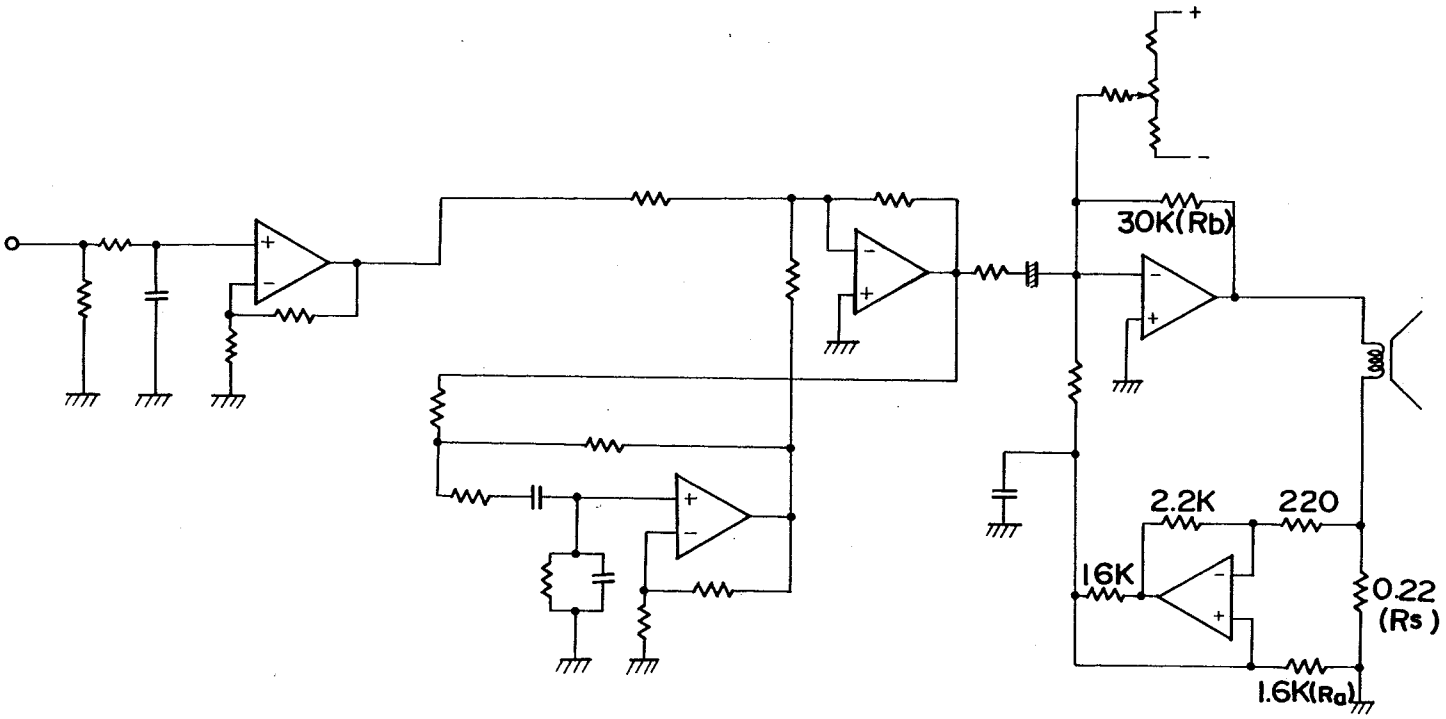
FIG. 5 is a circuit diagram showing an example of the circuit shown in FIG. 4.

FIG. 5 shows a detailed circuit of an amplifier including a negative resistance component in an output impedance.

The output impedance $Z_O$ in the amplifier shown in FIG. 5 is given by:

$$\begin{aligned} Z_O &= R_S(1 - R_b/R_a) \\ &= 0.22(1 - 30/1.6) \\ &= -3.9(\Omega) \end{aligned}$$

In the circuit shown in FIG. 3, if one of A, $\beta$, and $Z_S$ is caused to have characteristics in which its a value changes according to a frequency (to be referred to as frequency dependency hereinafter), the output impedance $Z_O$ can have the frequency dependency.

Figure 6:
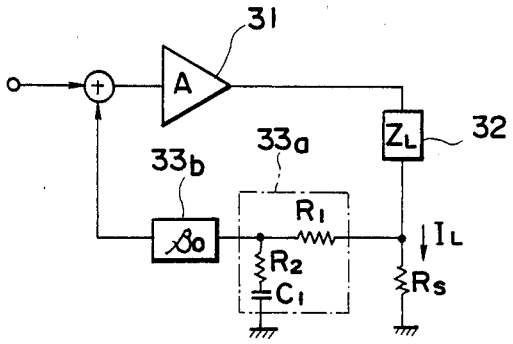
FIG. 6 is a circuit diagram showing a first example of the first embodiment.
Figure 7:
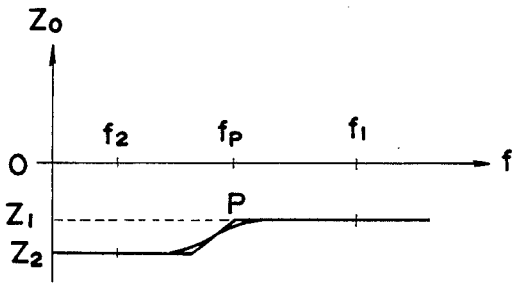
FIG. 7 is a graph showing frequency characteristics of an output impedance of the circuit shown in FIG. 6.

FIG. 6 shows a circuit arrangement when output impedances $Z_1$ and $Z_2$ at frequencies $f_1$ and $f_2$ are negative impedances and can be close to each other. The circuit shown in FIG. 6 employs a current detection resistor $R_S$ as a sensor for detecting the current $I_L$, and employs as the negative feedback circuit 33, a CR circuit 33*a* which consists of a capacitor $C_1$ and resistors $R_1$ and $R_2$ and whose transmission gain has frequency dependency (frequency characteristics in a predetermined range are not flat), and an amplifier 33*b*whose transmission gain does not have frequency dependency (transmission gain is constant in the predetermined range), so that the transmission gain $\beta$ has frequency dependency in the negative feedback circuit 33 as a whole. Note that if the CR circuit 33*a* is included in the current detection sensor $Z_S$, the sensor $Z_S$ can be regarded to have frequency dependency. FIG. 7 shows frequency characteristics of the circuit shown in FIG. 6.

In FIG. 7, $$Z_1 = R_S\left(1 - A \cdot \frac{R_2}{R_1 + R_2} \cdot \beta_O\right)$$

$$Z_2 = R_S(1 - A\beta_O)$$

A frequency $f_P$ at an inflection point P where an output impedance falls from $Z_1$ toward $Z_2$ when an output impedance curve is line approximated in accordance with the Nyquist method is almost $\frac{1}{2}\pi C_1 R_2$.

Figure 8:
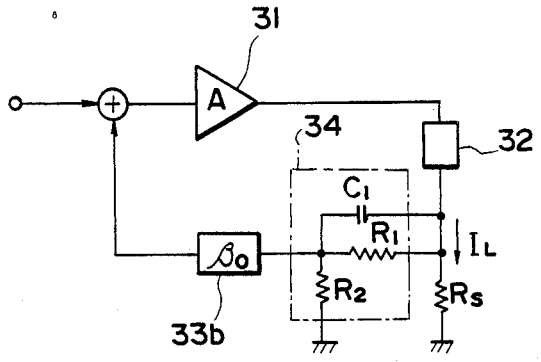
FIG. 8 is a circuit diagram showing a second example of the first embodiment.
Figure 9:
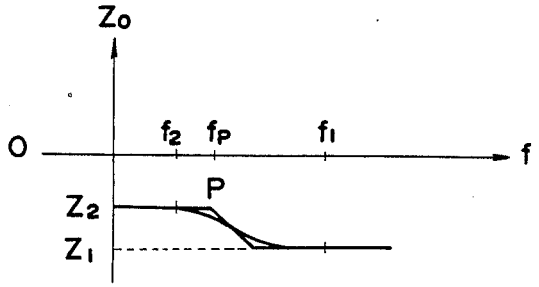
FIG. 9 is a graph showing frequency characteristics of an output impedance of the circuit shown in FIG. 8.

FIG. 8 shows a circuit when $Z_1<Z_2>0$, and FIG. 9 shows frequency dependency of the circuit shown in FIG. 8. In FIG. 9, $$Z_1 = R_S(1 - A\beta_O)$$

$$Z_2 = R_S\left(1 - A \cdot \frac{R_2}{R_1 + R_2} \cdot \beta_O\right)$$

The inflection point frequency $f_P$ is almost $\frac{1}{2}\pi C_1 R_1$.

Figure 10:
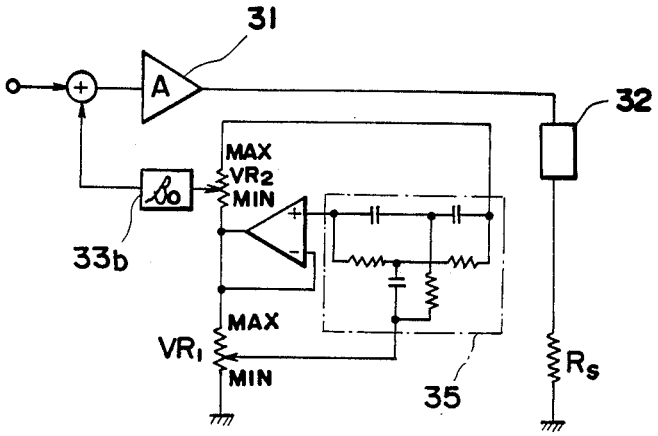
FIG. 10 is a circuit diagram showing a third example of the first embodiment.
Figure 11:
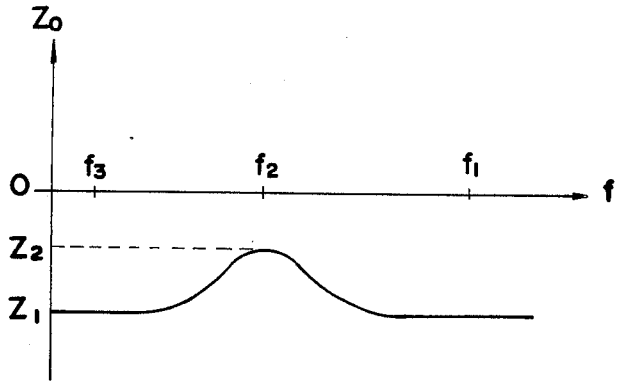
FIGS. 11 to 14 are graphs showing frequency characteristics of an output impedance in accordance with various setting states of constants in the circuit shown in FIG. 10.
Figure 12:
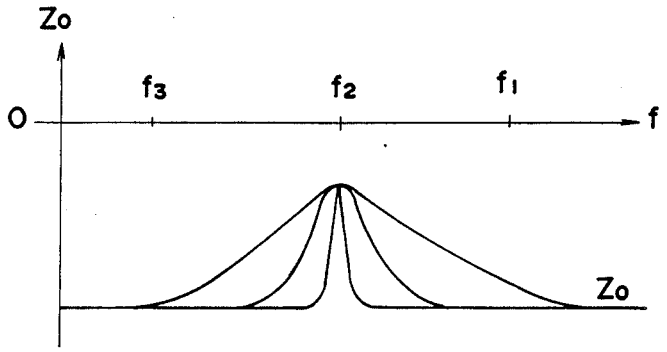
Figure 13:
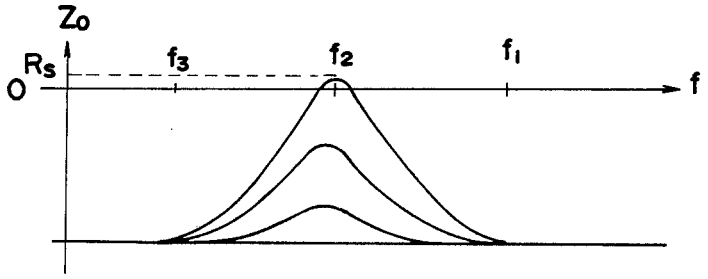

FIG. 10 shows a circuit when $Z_1<Z_2$ and $Z_2$ is largely changed with respect to $Z_1$. In the circuit shown in FIG. 10, a signal having a dip at a frequency $f_2$ is fed back to an amplifier 31 by a twin T circuit 35 whose dip frequency is set at $f_2$. For this reason, an output impedance only near the frequency $f_2$ can be increased, as shown in FIG. 11. In the circuit shown in FIG. 10, output impedances $Z_1$ and $Z_3$ at frequencies $f_1$ and $f_3$ are given by:

$$Z_1=Z_3=R_S(1-A\beta_O)$$

and can be set to be arbitrary values by selecting $\beta_O$. The shape of the curve in FIG. 11 can be varied by a variable resistor $VR_1$ in the circuit shown in FIG. 10, as shown in FIG. 12, and can be varied by a variable resistor $VR_2$, as shown in FIG. 13.

Figure 14:
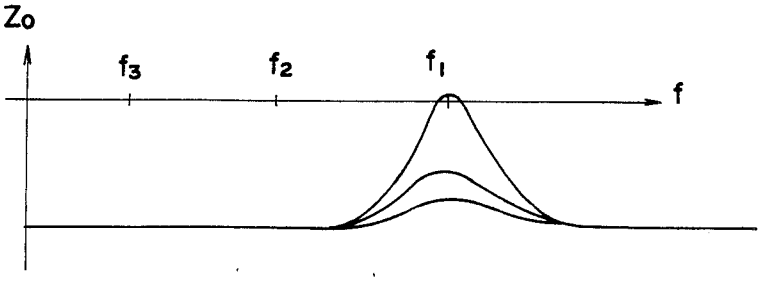

In the circuit shown in FIG. 10, if the dip frequency of the twin T circuit 35 is set at $f_1$, $Z_1>Z_2$ and $Z_3$ can be established, as shown in FIG. 14. A resonance at the frequency $f_3$ is not associated with a sound pressure. In the circuits in FIGS. 6, 8, and 10, the output impedance $Z_3$ at the frequency $f_3$ is set to be a negative impedance to decrease a Q value $Q_3$ at the frequency $f_3$. Thus, the speaker 32 is sufficiently damped so as not to be wastefully moved.

Figure 15:
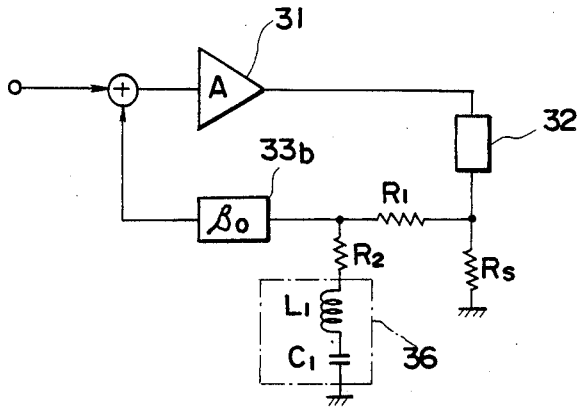
FIG. 15 is a circuit diagram showing a fourth example of the first embodiment, which is operated in the same manner as the circuit shown in FIG. 10.

FIG. 15 shows a modification of the circuit shown in FIG. 10, in which an LC resonance circuit 36 is used in place of the twin T circuit 35. In this manner, when the LC resonance circuit 36 is used, the same operation as in the circuit shown in FIG. 10 can be achieved.

Figure 16:
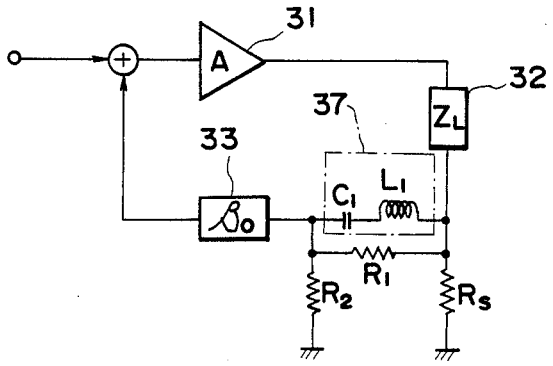
FIG. 16 is a circuit diagram showing a fifth example of the first embodiment.

FIG. 16 shows a circuit wherein an LC resonance circuit 37 is connected in series with a feedback system. In the circuit shown in FIG. 16, a feedback amount (transmission gain $\beta$) is maximized at a resonance frequency of this LC resonance circuit 37, which is given by:

$$f = \frac{1}{2\pi\sqrt{L_1C_1}}$$

Figure 17:
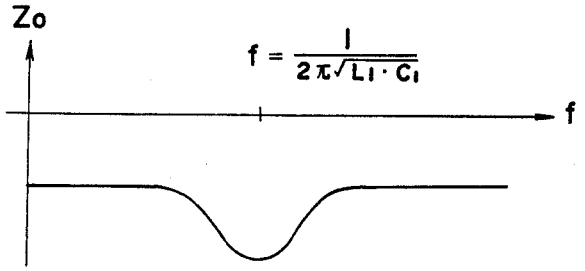
FIGS. 17 to 19 are graphs showing frequency characteristics of an output impedance according to various setting states of constants in the circuit shown in FIG. 16.

Therefore, as shown in FIG. 17, the output impedance at the frequency f can be minimized.

Figure 18:
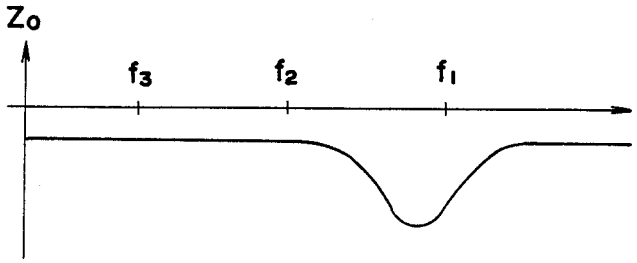
Figure 19:
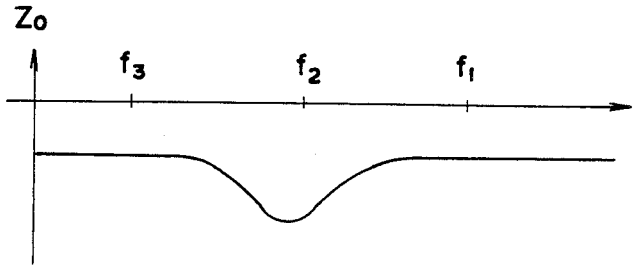

When the frequency f is set at $f_1$ or $f_2$, the output impedances $Z_1$ and $Z_2$ can be set considerably different from each other, as shown in FIG. 18 or 19.

Figure 20:
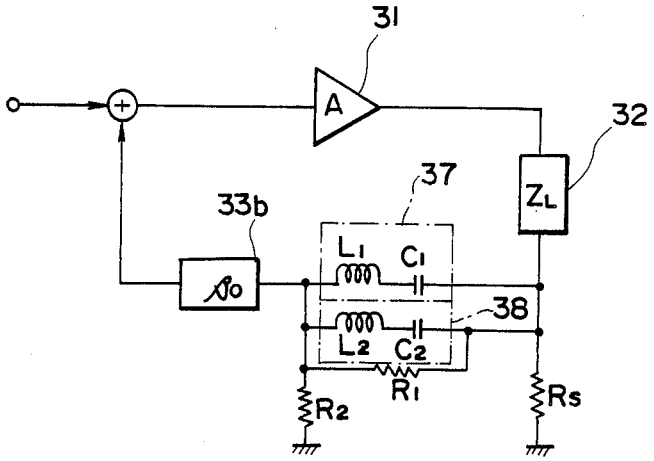
FIG. 20 is a circuit diagram showing a sixth example of the first embodiment.
Figure 21:
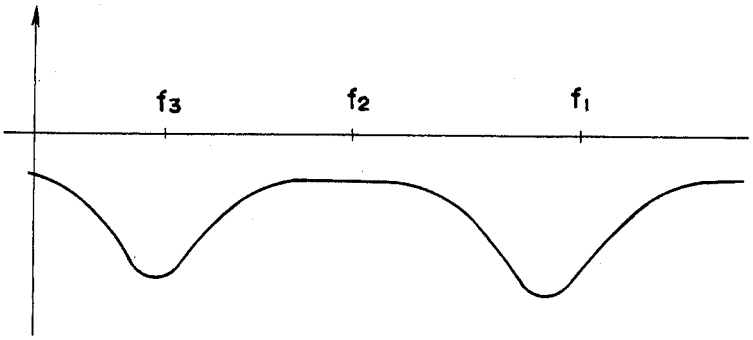
FIG. 21 is a graph showing frequency characteristics of an output impedance of the circuit shown in FIG. 20.

FIG. 20 shows a circuit wherein a second LC resonance circuit 38 which is resonated at the frequency $f_3$ is added to the circuit shown in FIG. 17. As shown in FIG. 21, when the output impedance at the frequency $f_3$ is decreased, the Q value $Q_3$ is decreased. With this arrangement, a wasteful movement of the speaker 32 can be effectively prevented. In FIG. 21, $$f_1 = \frac{1}{2\pi\sqrt{L_1C_1}}$$

$$f_3 = \frac{1}{2\pi\sqrt{L_2C_2}}$$

In the above circuit, the output impedance $Z_O$ is $Z_O=R_S(1-A\beta)$, and when $\beta\geqq 0$, the maximum value of $Z_O$ is $R_S$. When the feedback circuit 33 is used for both positive and negative feedback operations, one of $Z_1$ and $Z_2$ can be set to be a negative value, while the other can be set to be a positive value larger than $R_S$.

Figure 22:
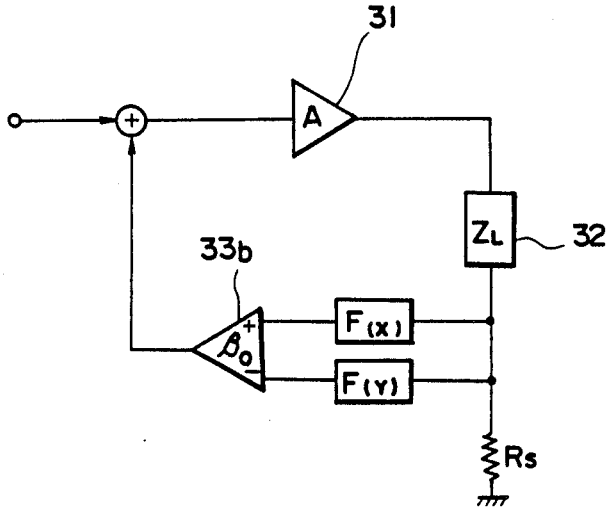
FIG. 22 is a circuit diagram showing a seventh example of the first embodiment.

FIG. 22 shows a circuit whose transmission gain is given by:

$$\beta=\beta_O\{F(X)-F(Y)\}$$

and which has both positive and negative components.

As shown in FIG. 22, when the feedback circuit 33 is caused to have given transmission characteristics F(X) and −F(Y), $\beta>0$ is established in a range wherein the gain of F(X) exceeds F(Y). Since $Z_O=R_S(1-A\beta)$, the output impedance is equal to or smaller than $R_S$, and a negative impedance can be realized when $A\beta>1$. Contrary to this, since $\beta<0$ is established in a range where the gain of F(Y) exceeds F(X), the output impedance becomes a positive impedance equal to or larger than $R_S$.

In this manner, the speaker system having a bass-reflex structure is driven by a negative impedance at least at one of resonance points $f_1$ and $f_2$ associated with its sound pressure, and output impedance values $Z_1$ and $Z_2$ at the resonance points $f_1$ and $f_2$ are set to yield $Z_1\neq Z_2$. Thus, the Q values $Q_1$ and $Q_2$ at the corresponding resonance points $f_1$ and $f_2$ can be independently set, and a damping force, performance, and sound quality can be improved.

(Modification of Embodiment)

In the above embodiment, the resistor $R_S$ is used as a current detection sensor. As the sensor, however, a current probe such as a current transformer (C.T.) or a Hall element may be used. As the sensor, a reactance element such as a capacitor or inductance may be used. In this case, the sensor itself can have frequency dependency. When the output from the sensor is differentiated or integrated, frequency dependency or flat frequency characteristics can be provided. For example, the current $I_L$ is detected by a terminal voltage of the resistor $R_S$, and is differentiated or integrated by the feedback circuit 33, so that the transmission gain $\beta$ can have frequency dependency. Alternatively, the current $I_L$ is detected by a terminal voltage of the capacitor and is differentiated by the feedback circuit 33, so that the frequency dependency of the transmission gain $\beta$ becomes flat.

In order to provide frequency dependency to the feedback circuit 33, current or voltage feedback may be performed in the feedback amplifier (33*b* in FIG. 6) itself.

(Second Embodiment)

Figure 23:
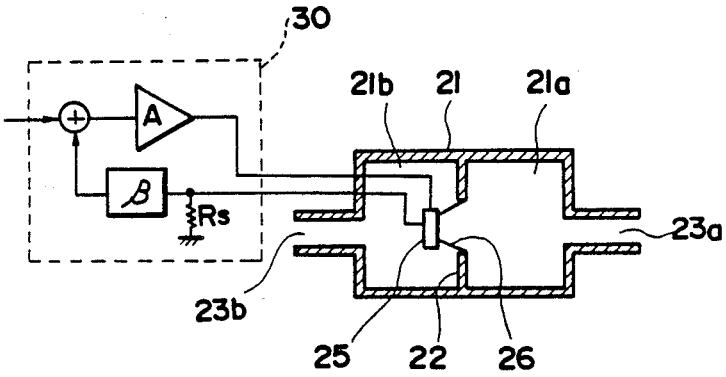
FIG. 23 is a diagram showing a basic arrangement of an acoustic apparatus according to a second embodiment of the present invention.
Figure 45:
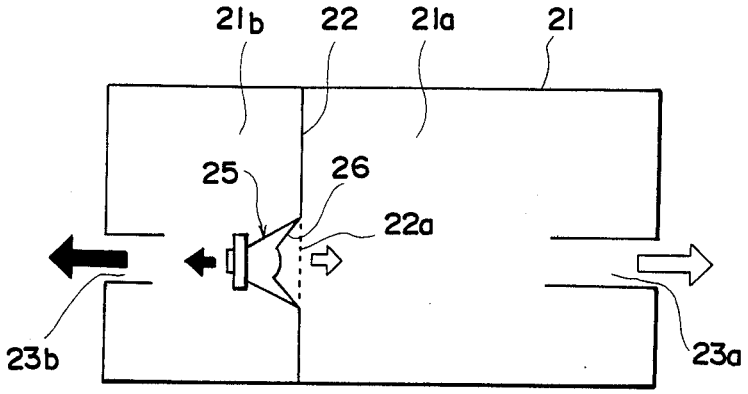
FIG. 45 is a sectional view showing an arrangement of a double bass-reflex speaker system.
Figure 46:
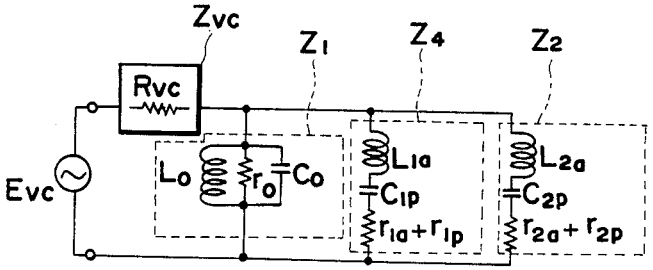
FIG. 46 is an electrically equivalent circuit diagram when the speaker system shown in FIG. 45 is driven at a constant voltage.
Figure 47:
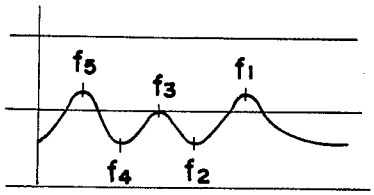
FIG. 47 is a graph showing electrical impedance-frequency characteristics of the speaker system shown in FIG. 45.
Figure 48:
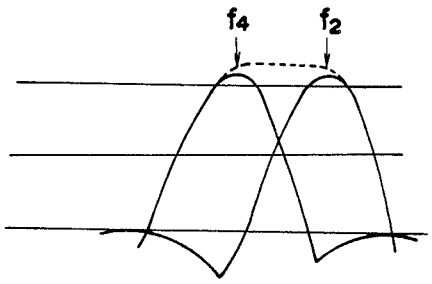
FIG. 48 is a graph showing an acoustic output of the speaker system shown in FIG. 45.
Figure 49:
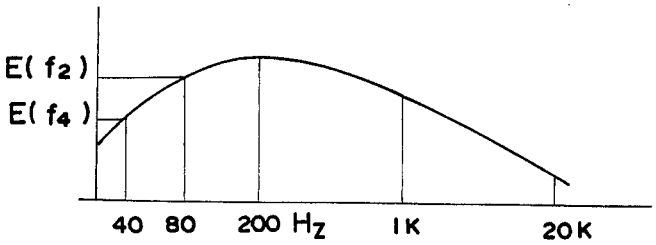
FIG. 49 is a graph showing an average energy spectrum of a music piece.

FIG. 23 shows a basic arrangement of an acoustic apparatus according to a second embodiment of the present invention. In the acoustic apparatus shown in FIG. 45, a cabinet 21 is made compact as compared to the conventional apparatus shown in FIG. 45, and opening ports (resonance ports) 23*a* and 23*b* which are difficult to be housed in the cabinet 21 accordingly are arranged to extend outwardly from the cabinet 21. As a driving apparatus for driving a vibrator (speaker unit) 25 mounted on a partition plate 22, a driving apparatus 30 which includes a negative impedance in an output impedance at least at one frequency of resonance frequencies $f_2$ and $f_4$ associated with a sound pressure output of five resonance frequencies $f_1$, $f_2$, $f_3$, $f_4$ and $f_5$ shown in FIG. 47, is used.

Figure 24:
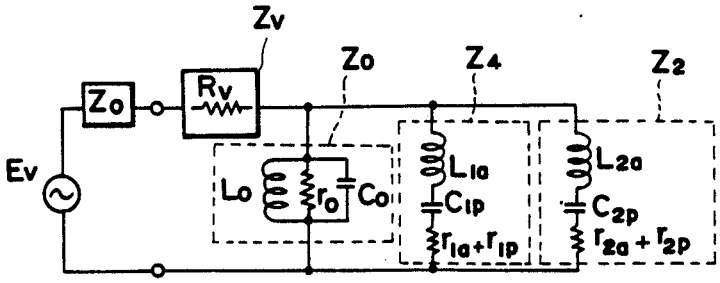
FIGS. 24 and 25 are electrically equivalent circuit diagrams of the apparatus shown in FIG. 23.
Figure 25:
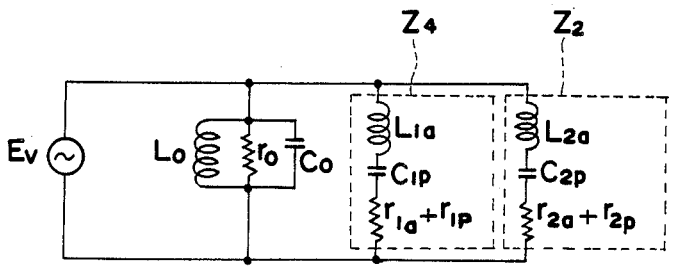

FIG. 24 shows an electrically equivalent circuit of FIG. 23. FIG. 25 shows an electrically equivalent circuit when $Z_V-Z_O=0$ in FIG. 24, i.e., an internal impedance inherent in the vibrator 25 is equivalently completely invalidated.

In the state shown in FIG. 25, two ends of each of series resonance circuits $Z_4$ and $Z_2$ by equivalent motional impedances of Helmholtz resonators formed by chambers 21*a* and 21*b* and the opening ports 23*a* and 23*b* are short-circuited in an AC manner. Therefore, equivalent resistors equivalently connected in series with these series resonance circuits $Z_4$ and $Z_2$ are only $r_{1a}$, $r_{1p}$, $r_{2a}$, and $r_{2p}$. The Q values of these series resonance circuits $Z_4$ and $Z_2$ respectively become $R_{VC}/(r_{1a}+r_{1p})$ times and $R_{VC}/(r_{2a}+r_{2p})$ times those obtained when the system is driven at a constant voltage. Since the resistances of these equivalent resistors $r_{1a}$, $r_{1p}$, $r_{2a}$, and $r_{2p}$ are negligibly small as compared to the voice coil resistor $R_{VC}$, as described above, the Q values of the series resonance circuits $Z_4$ and $Z_2$ can be greatly increased as compared to a case wherein the system is driven at a constant voltage.

Figure 1:
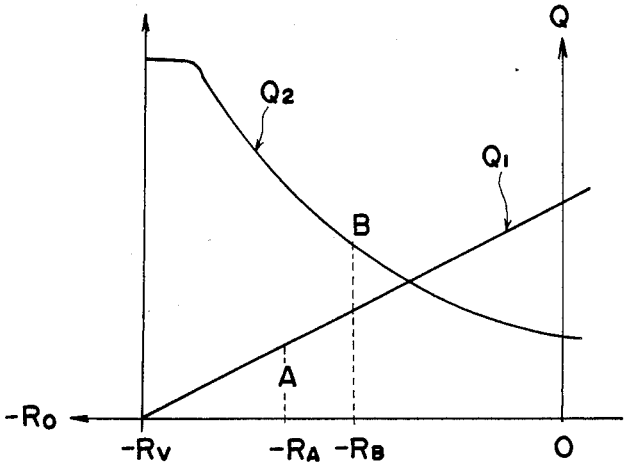
FIGS. 1 and 2 are graphs showing the relationship between an output impedance and a Q value for explaining the principle of the present invention.
Figure 2:
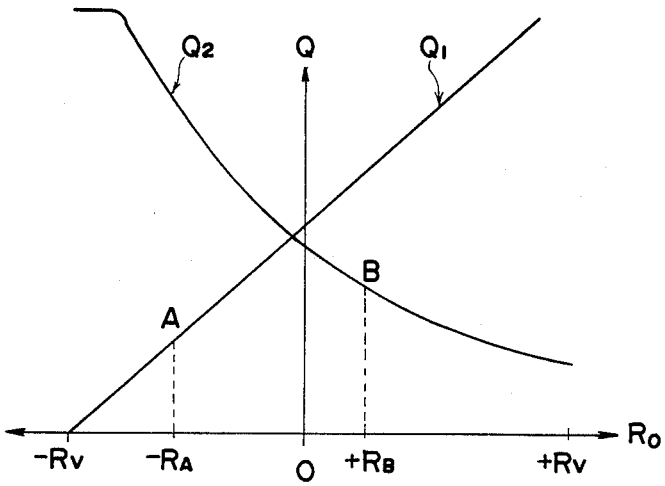
Figure 26:
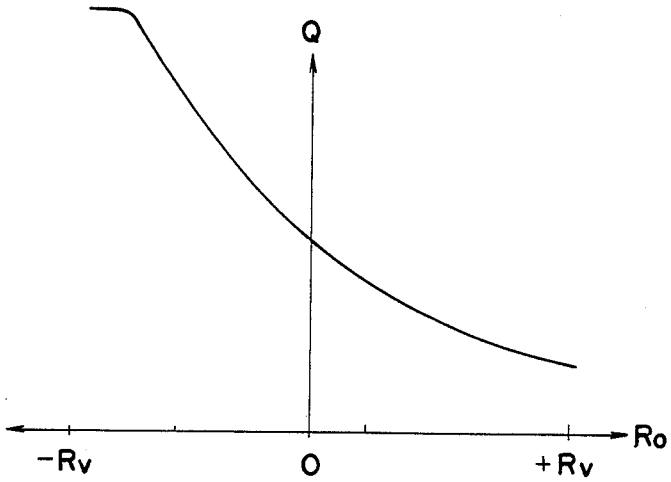
FIG. 26 is a graph showing the relationship between an output impedance of a driving apparatus and a Q value of a resonator.

FIG. 26 shows the relationship between the output impedance and the Q value of the driving apparatus 30. This relationship is represented by the same curve as that of the relationship between the output impedance and $Q_2$ of the driving apparatus shown in FIGS. 1 and 2. As can be seen from FIG. 26, the Q value of the series resonance circuit can be increased by the negative-impedance driving, and can be set to be equal to or smaller than that by the conventional constant-voltage driving by zero- or positive-impedance driving. The Q value at the frequency $f_4$ is decreased upon making the cavity 21*a* compact in the conventional constant-voltage driving. However, in the acoustic apparatus shown in FIG. 23, the driving apparatus 30 has a negative impedance at the frequency $f_4$ and therefore the Q value can be sufficiently increased compensating for an amount which would be decreased by the constant-voltage driving. More specifically, in the structure shown in FIG. 23, a Q value which is to be highest is the Q value $Q_4$ at the resonance frequency $f_4$. In the constant-voltage driving, when the cavity 21*a* is decreased in volume, the value $Q_4$ is decreased. However, in the acoustic apparatus shown in FIG. 23, even if the volume of the cavity 21*a* is decreased, the resonance Q value $Q_4$ at the resonance frequency $f_4$ can be set to be sufficiently large by setting an appropriate negative impedance as the output impedance of the driving apparatus 30. For this reason, the cabinet can be rendered compact, thus realizing a compact system.

If the output impedances of the driving apparatus 30 are the same at the frequencies $f_4$ and $f_2$, the Q value can be easily set to be higher at the frequency $f_2$ (higher than the frequency $f_4$) than at the frequency $f_4$, and an output sound pressure level is also high, as described above. Therefore, flat sound pressure output characteristics cannot be obtained between the frequencies $f_4$ and $f_2$. This can be solved as follows. That is, the output impedance of the driving apparatus 30 is set to have frequency dependency so that the output impedance becomes negative at the frequency $f_4$ and the output impedance at the frequency $f_2$ becomes higher than that at the frequency $f_4$.

As a negative impedance generating circuit for driving the vibrator by the negative impedance as described above, the same circuit as that described in the first embodiment represented by the basic arrangement shown in FIG. 3 can be used. In this case, the circuit and constants must be selected taking into consideration the fact that resonance frequencies of interest are series resonance frequencies $f_2$ and $f_4$, and to allow use of a smaller cabinet, the output impedance $Z_4$ at the frequency $f_4$ must be set to be negative and the output impedance $Z_2$ at the frequency $f_4$ must be set to be higher (or larger) than $Z_4$.

Figure 27:
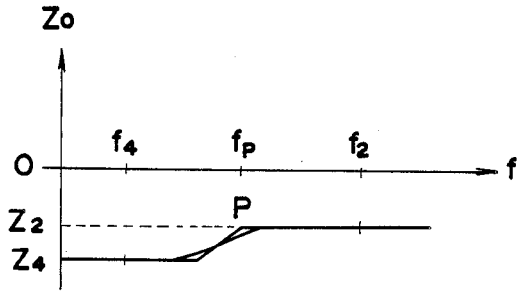
FIG. 27 is a graph showing frequency characteristics of an output impedance when the circuit with the arrangement shown in FIG. 8 is used as the driving apparatus in FIG. 23.

For example, as the driving apparatus 30, the circuit shown in FIG. 6 can be used. FIG. 27 shows frequency characteristics in this case. In FIG. 27, $$Z_2 = R_S\left(1 - A \cdot \frac{R_2}{R_1 + R_2} \cdot \beta_O\right)$$

$$Z_4 = R_S(1 - A\beta_O)$$

The frequency $f_p$ at the inflection point P is almost $\frac{1}{2}\pi C_1 R_2$.

In the description of the first embodiment, the same circuit as in FIG. 22 can be used as the driving apparatus 30 of the second embodiment.

Figure 28:
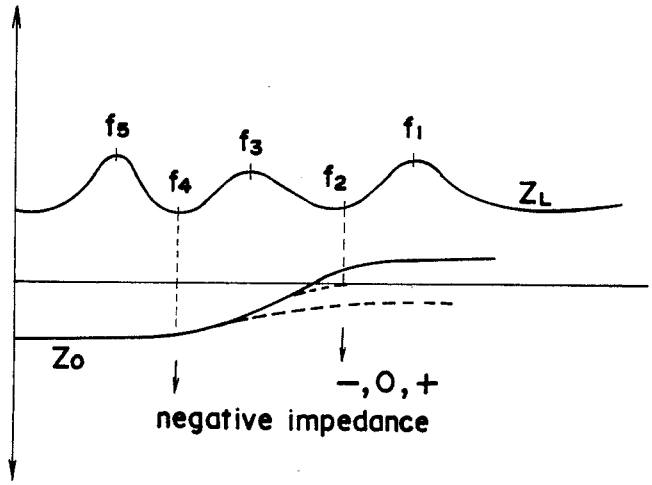
FIG. 28 is a graph showing frequency characteristics of an impedance of the acoustic apparatus shown in FIG. 23 and an output impedance of the driving apparatus when the circuit with the arrangement shown in FIG. 22 is used as the driving apparatus in FIG. 23.

Since the transmission gain $\beta$ of the circuit shown in FIG. 22 has both positive and negative components as expressed by:

$$\beta = \beta_O\{F(X) - F(Y)\}$$

this circuit can realize frequency characteristics in which the output impedance changes between the positive and negative levels, as shown in FIG. 28.

When the vibrator 25 of the double bass-reflex speaker system shown in FIG. 23 is driven by the driving apparatus 30 having output impedance characteristics as shown in FIG. 28, both a compact system and high efficiency can be achieved. For example, in the conventional system shown in FIG. 45, the cavity 21*a* is reduced in size, and the output impedance of the driving apparatus at the resonance frequency $f_4$ is set to be negative so as to increase the Q value. Meanwhile, the cavity 21*b* is designed to be relatively larger than a conventional one to improve efficiency, and the system is driven by the positive impedance, thereby decreasing the Q value. FIG. 28 shows the relationship between the resonance frequency of the resonator and the output impedance of the driving apparatus 30 when the system is driven as described above.

In the above embodiment, the opening port is used as an acoustic mass means constituting the resonator. However, the acoustic mass means may be a simple opening or may be a passive vibrating body such as a drone cone.

(Third Embodiment)

Figure 29:
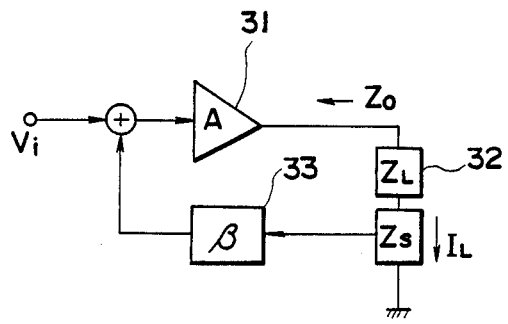
FIG. 29 is a circuit diagram showing a basic arrangement according to a third embodiment of the present invention.

FIG. 29 shows a basic circuit arrangement of a driving apparatus according to a third embodiment of the present invention. The basic arrangement in FIG. 29 is completely the same as that shown in FIG. 3, and its output impedance $Z_O$ is represented by $Z_O = Z_S(1 - A>)$. *When* $A\beta > 1$, the output impedance becomes an open-stable negative impedance, and when $A\beta \leqq 1$, it becomes 0 or a positive impedance.

Figure 43:
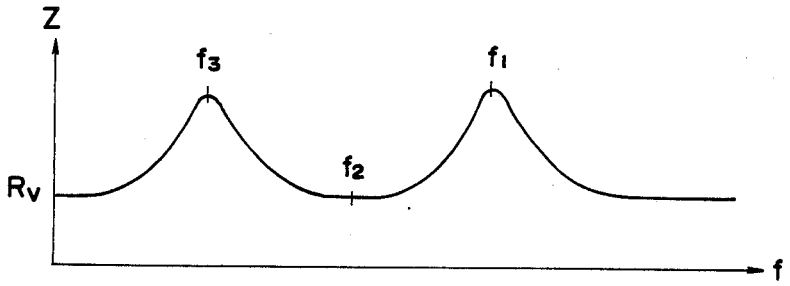
FIG. 43 is a graph showing electrical impedance-frequency characteristics of the equivalent circuit shown in FIG. 42.
Figure 44:
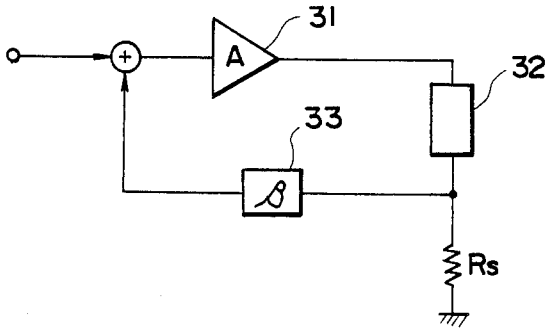
FIG. 44 is a circuit diagram showing a negative impedance generating circuit according to a prior application.
Figure 50:
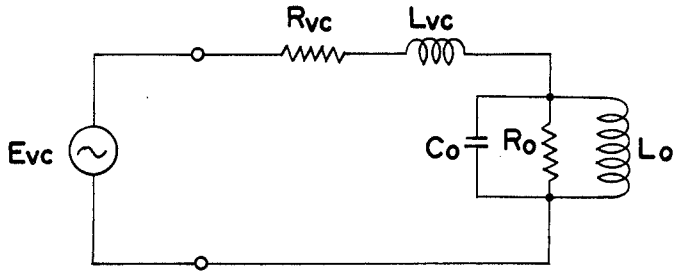
FIG. 50 is an electrically equivalent circuit diagram when a dynamic speaker is mounted on an infinite baffle and is driven at a constant voltage.
Figure 51:
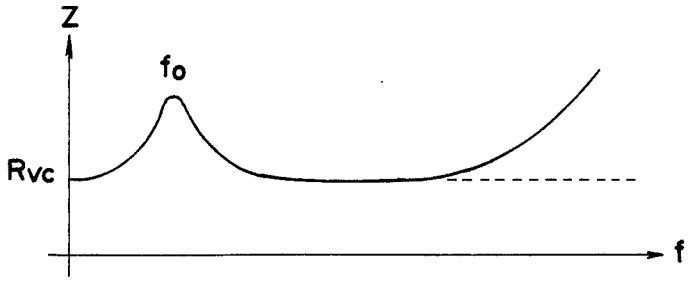
FIG. 51 is a graph showing electrical impedance-frequency characteristics of the equivalent circuit shown in FIG. 50.

For example, if a speaker 32 is a dynamic speaker unit whose equivalent circuit is shown in FIG. 50, when $A\beta > 1$ is set in FIG. 29 and the detection resistor $R_S$ like in the prior application apparatus shown in FIG. 43 is used as the current detection impedance $Z_S$ in FIG. 29, the output impedance becomes $Z_O = R_S(1 - A\beta) = -R_O$, i.e., a negative resistance. The negative-resistance driving in which the speaker unit is driven while a negative resistance is used as the output impedance can effectively, equivalently reduce the value of the voice coil resistor $R_{VC}$. Thus, the vibration system can be operated at a constant speed, thereby increasing a driving force and a damping force.

Figure 30:
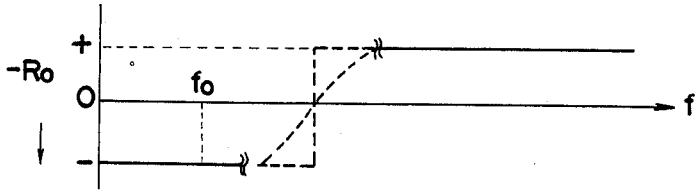
FIG. 30 is a graph showing frequency characteristics of an output impedance for explaining the principle of the third embodiment.
Figure 31A:
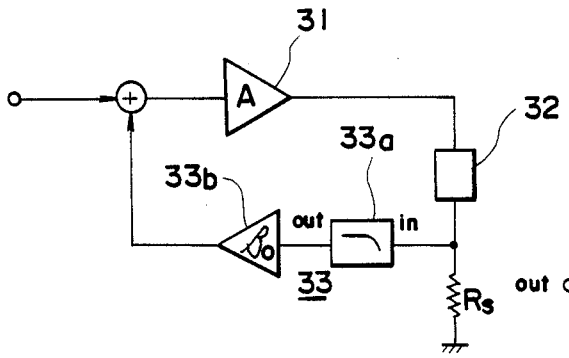
FIGS. 31A and 31B are circuit diagrams showing a first example of the third embodiment.

When the negative-resistance driving is also performed in a high-frequency range, the impedance of the equivalent capacitance $C_O$ is decreased in the high-frequency range and the high-frequency range driving current is determined by the resistor $R_{VC}$ and the impedance of the inductor $L_{VC}$. Therefore, when the resistance of the resistor $R_{VC}$ is decreased by the negative-resistance driving, the high-frequency driving current tends to be influenced by $L_{VC}$. Therefore, in the high-frequency range, the driving impedance is preferably high to reduce the influence of $L_{VC}$. A constant-speed operation is difficult to achieve at a frequency separated from the resonance frequency $f_O$, and the high-frequency region is originally a mass control region, and it is less significant even if the constant-speed operation is achieved in this region In the third embodiment, the output impedance of the driving apparatus is set to be $A\beta > 1$, i.e., a negative impedance at a low frequency near the resonance frequency $f_O$, as shown FIG. 30, and is set to be $A\beta < 1$, i.e., a positive impedance at a high frequency at which the electrical inductance $L_{VC}$ of the voice coil begins to function In order to vary or switch the output impedance between negative and positive levels in accordance with a frequency, A or $\beta$ can be varied or switched in accordance with the frequency. In this embodiment, the way of a change in output impedance in an intermediate frequency range between the high- and low-frequency ranges is not particularly limited FIG. 31A shows a circuit arrangement of a driving apparatus in which the feedback circuit 33 is arranged to have a large positive feedback amount $\beta$in a low-frequency range and a small feedback amount in a high-frequency range The circuit shown in FIG. 31A uses the current detection resistor $R_S$ as a sensor for detecting the current $I_L$, and the feedback circuit 33 is constituted by an amplifier 33*b* having a gain $\beta_O$ and an LPF (low-pass filter) 33*a* for allowing only a low-frequency component of an AC voltage signal generated at the current detection resistor $R_S$ to pass therethrough and to inputting it into the amplifier 33*b*.

Figure 31B:
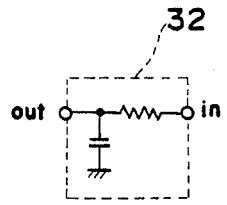

As the LPF 33*a*, a circuit shown in FIG. 31B may be used. A gain G of this circuit is $G \approx 1$ for a low-frequency signal, and is $G \approx 0$ for a high-frequency signal. Therefore, in FIG. 31A, when the circuit shown in FIG. 31B is used as the LPF 33*a* and the gain A of the amplifier 31 and the gain $\beta_O$ of the amplifier 33 are set to satisfy $A\beta_O > 1$, since $A\beta = A(\beta_O G) \approx A\beta_O > 1$ for the low-frequency signal, the output impedance $Z_O$ is given by:

$$Z_O = R_S(1 - A\beta_O) = -R_O < 0$$

and becomes the negative resistance $-R_O$, as described above with reference to FIG. 29. Since $A\beta = A(-\beta_O G) \approx 0$ for the high-frequency signal, the output impedance is given by:

$$Z_O = R_S(1 - A\beta) \approx R_S$$

Figure 32:
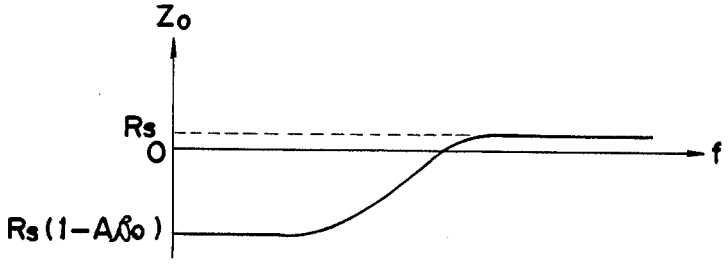
FIG. 32 is a graph showing frequency characteristics of an output impedance of the circuit shown in FIG. 31.

Therefore, the output impedance becomes a positive impedance almost equal to the value of $R_S$ itself. More specifically, the circuit shown in FIG. 31A has a negative output impedance in a low-frequency range and a positive output impedance in a high-frequency range, as shown in FIG. 32.

Figure 33:
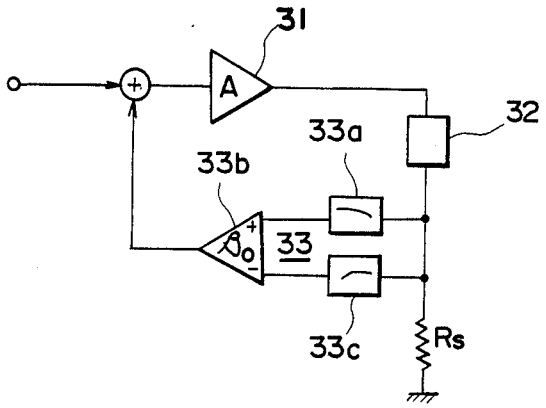
FIG. 33 is a circuit diagram showing a second example of the third embodiment.

FIG. 33 shows a circuit arrangement of a driving apparatus in which the feedback circuit 33 is used for both positive and negative feedback operations. The circuit shown in FIG. 33 uses the current detection resistor $R_S$ as a sensor for detecting the current $I_L$, and the feedback circuit 33 is constituted by an amplifier 33*b* of a gain $\beta_O$ having positive (non-inverting) and negative (inverting) input terminals, an LPF 33*a* for allowing only a low-frequency component of an AC voltage signal generated at the current detection resistor $R_S$ to pass therethrough to input it to the positive input terminal of the amplifier 33*b*, and an HPF (high-pass filter) 33*c* for allowing only a high-frequency component of the AC voltage signal generated at the current detection resistor $R_S$ to pass therethrough to supply it to the negative input terminal of the amplifier 33*b*.

Therefore, in the circuit shown in FIG. 33, for a low-frequency signal, $\beta>0$ is established and the output impedance is:

$$Z_O=R_S(1-A\beta_O)$$

Therefore, the output impedance becomes smaller than $R_S$, and when $A\beta_O>1$, a negative impedance can be realized. On the other hand, for a high-frequency signal, since $\beta<0$, $$Z_O=R_S(1+A\beta_O)$$

Therefore, the output impedance becomes a positive impedance larger than $R_S$.

A similar circuit has already been illustrated in FIG. 22. The circuits shown in FIGS. 33 and 22 have different setting standards of cutoff frequencies of filters and gains of pass-bands (passage gain).

Figure 34:
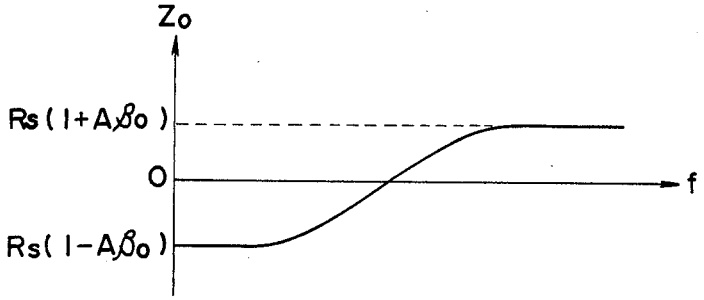
FIG. 34 is a graph showing frequency characteristics of an output impedance of the circuit shown in FIG. 33.

FIG. 34 shows frequency dependency of the output impedance of the circuit shown in FIG. 33.

Figure 35:
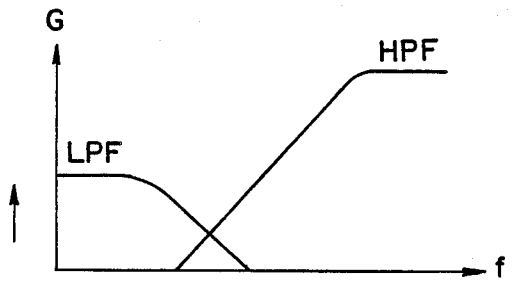
FIG. 35 is a graph showing characteristics of filters (LPF and HPF) for explaining a modification of FIG. 33.
Figure 36:
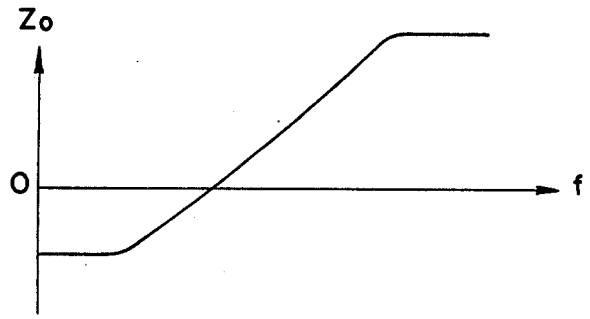
FIG. 36 is a graph showing frequency characteristics of an output impedance of the circuit using the filters shown in FIG. 35.

Note that in the circuit shown in FIG. 33, when the LPF 33*a* and the HPF 33*c* have different gains, the absolute value of the positive impedance can be different from that of the negative impedance. For example, when the gain of the HPF 33*c* is set to be larger than that of the LPF 33*a*, as shown in FIG. 35, the absolute value of the positive impedance can be set to be larger than that of the negative impedance, as shown in FIG. 36.

Figure 37:
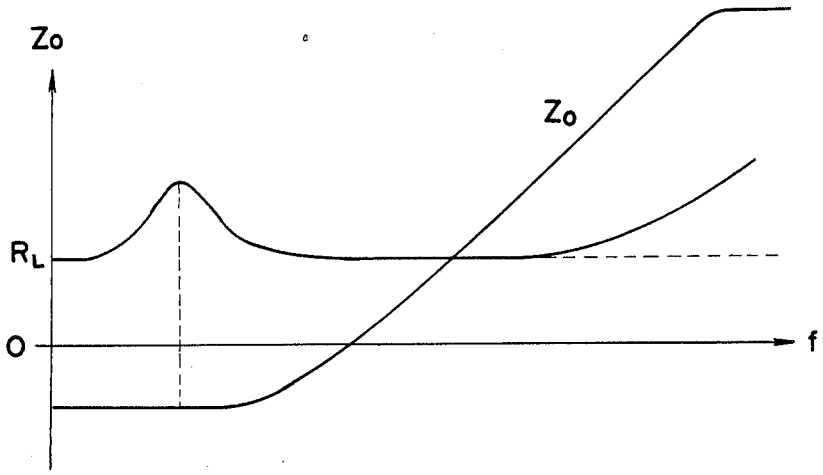
FIG. 37 is a graph showing frequency characteristics of an output impedance of the circuit using the filters shown in FIG. 35 in comparison with an impedance of a dynamic speaker unit.

In this manner, the gain of the HPF 33*c* is set to be larger than that of the LPF 33*a*, so that the output impedance $Z_O$ is set to be a negative impedance of $|Z_O|<R_{VC}$ in a low-frequency range, and to be a positive impedance of $Z_{LVC}<<|Z_O|$ with respect to an impedance $Z_{LVC}$ of the inductance $L_{VC}$ of the voice coil, as shown in FIG. 37. As a result, a damping force for the speaker 32 is increased near the resonance frequency $f_O$ of the speaker 32, and the influence of the inductance $L_{VC}$ of the voice coil, i.e., an acoustic distortion can be eliminated in a high-frequency range.

Note that when the frequency dependency of the output sound pressure is changed upon a change in driving impedance, the change can be corrected at an input $V_i$ side as needed.

The driving apparatus has both an effect of improving high-frequency characteristics (in particular, distortion characteristics) and an effect of increasing a damping force in a low-frequency range near the resonance frequency $f_O$. Therefore, the driving apparatus can be effectively applied to, particularly, a full-range speaker, or a mid-range speaker or tweeter in a multi-amplifier system.

Figure 38:
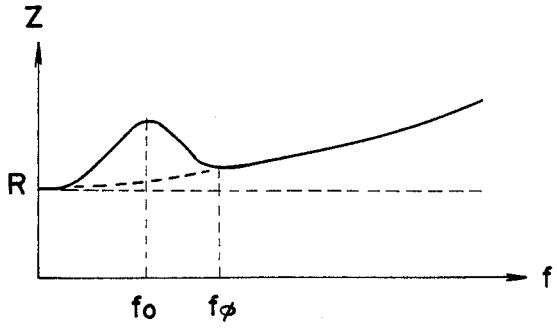
FIG. 38 is a graph showing frequency characteristics of a woofer.

In the tweeter or the like, the resonance frequency $f_O$ is separated from the frequency $f_{LVC}$ at which the inductance $L_{VC}$ of the voice coil begins to function. However, in many woofers or the like, as shown in FIG. 38, $f_O$ is approximate to $f_{LVC}$. In this case, the object may not be achieved with the output impedance characteristics shown in FIG. 32, 34, 36, or 37.

Figure 39:
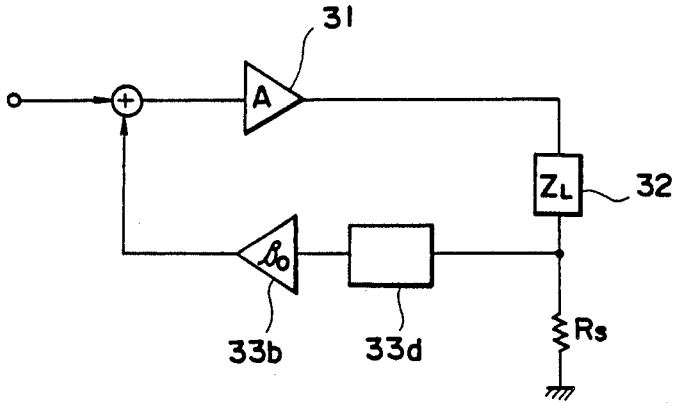
FIG. 39 is a circuit diagram showing a third example of the third embodiment.
Figure 40:
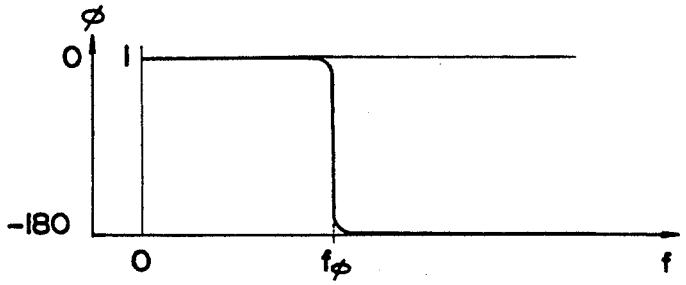
FIG. 40 is a graph showing frequency characteristics of a feedback filter in the circuit shown in FIG. 39.
Figure 41A:
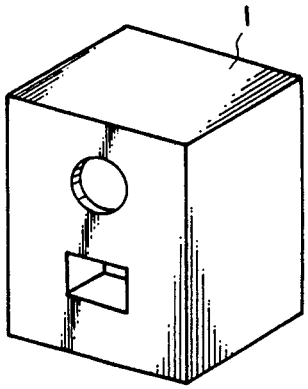
FIGS. 41A and 41B are respectively a perspective view and a sectional view showing an arrangement of a conventional bass-reflex speaker system.
Figure 41B:
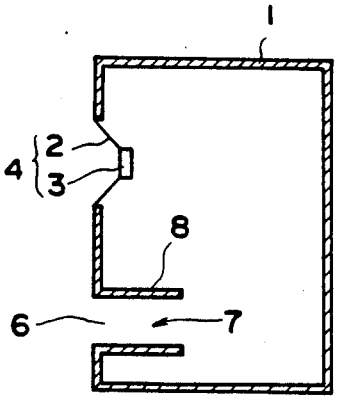
Figure 42:
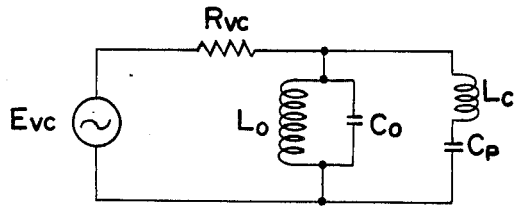
FIG. 42 is an electrical equivalent circuit diagram when the bass-reflex speaker system shown in FIG. 41 is driven at a constant voltage.

FIG. 39 shows a circuit arrangement of a driving apparatus which can be suitably used in a woofer or the like in which the resonance frequency $f_O$ is approximate to the frequency $f_{LVC}$ at which the inductance $L_{VC}$ of the voice coil begins to function The circuit shown in FIG. 39 uses a circuit constituted by an all-pass filter 33*d* and an amplifier 33*b* as the feedback circuit 33 in the circuit shown in FIG. 29. In FIG. 39, the all-pass filter 33*d* has a transmission gain of 1 in the entire region in a predetermined frequency range, and phase characteristics in which a phase is inverted through 180° at a predetermined frequency $f_\phi$ or higher.

Therefore, in the circuit shown in FIG. 39, for a low-frequency signal lower than the frequency $f_\phi$, since $\beta>0$, $$Z_O=R_S(1-A\beta_O)$$

Therefore, the output impedance becomes smaller than $R_S$, and when $A\beta_O>1$, a negative impedance can be realized. For a high-frequency signal higher than the frequency $f_\phi$, since $\beta<0$, $$Z_O=R_S(1+A\beta_O)$$

Therefore, the output impedance becomes a positive impedance larger than $R_S$.

Therefore, the phase inverting frequency $f_\phi$ is set at a frequency as shown in, e.g., FIG. 38, increases in damping force and driving force of the speaker unit and reduction of an acoustic distortion can be achieved at the same time.

(Application Range of Third Embodiment)

In the third embodiment, the case has been exemplified wherein the dynamic speaker unit is driven by the driving apparatus of the present invention. This embodiment can be applied to a speaker unit which can improve a damping force and driving force, or a design margin by eliminating or invalidating a non-motional impedance at its resonance frequency, and in which the adverse influence, e.g., an acoustic distortion by eliminating or invalidating the non-motional impedance is enhanced at a frequency other than the resonance frequency, e.g., an electromagnetic speaker unit, in addition to the dynamic speaker unit.

What is claimed is:

1. A driving apparatus for electrically driving a vibrator constituting an acoustic apparatus which reproduces signals in an audio range and has plural resonance frequencies at least one of which is associated with output sound pressure, the driving apparatus comprising:

a drive circuit having an output terminal for providing a drive signal to the vibrator, the drive circuit having an output impedance which is negative at at least one resonance frequency associated with the output sound pressure of said acoustic apparatus, the output impedance of the drive circuit having different values at different frequencies such that the ratio of the output impedance to an internal impedance inherent in said vibrator is not constant over the full reproduction range of said acoustic apparatus.

2. A driving apparatus for driving a vibrator which is arranged in a resonator constituted by a closed cavity and an acoustic mass means for causing said cavity to acoustically communicate with an external region so as to directly radiate an acoustic wave to the outside, the vibrator being driven to cause the resonator to radiate a resonant acoustic wave through said acoustic mass means to the outside, the driving apparatus comprising:

a driving circuit for providing a drive signal including audio frequencies to the vibrator, the driving circuit having an output impedance, wherein at least one of output impedances of said driving circuit at a first resonance frequency which is essentially determined by the motional impedance of said vibrator and the equivalent stiffness of said cavity and at a second resonance frequency which is the resonance frequency of said resonator is a negative impedance, and wherein the output impedances have different output impedance values.

3. A driving apparatus according to claim 2 in combination with the resonator and vibrator, wherein said resonator is a Helmholtz resonator which comprises (1) a cabinet having outer wall defining said cavity and (2) an opening or opening port formed on the outer wall of said cabinet as said acoustic mass means, and wherein said vibrator is mounted on the outer wall of said cabinet, a first surface of the vibrating body of said vibrator facing said external region, and a second surface thereof facing said cavity.

4. A driving apparatus according to claim 3, wherein said vibrator is a dynamic electro-acoustic transducer.

5. A driving apparatus for electrically driving one vibrator arranged to drive a plurality of resonators in parallel wherein each resonator is constituted by a closed cavity and acoustic mass means for causing the respective cavity to acoustically communicate with an external region and wherein the resonators have different resonance frequencies, comprising:

a driving circuit for providing a drive signal including audio frequencies to the vibrator, the driving circuit having an output impedance which is negative at at least a first frequency associated with the output sound pressure of the resonators among a plurality of resonance frequencies formed by said resonators and said vibrator, and the output impedance of the driving circuit at another frequency associated with the sound pressure is different from the output impedance at the first frequency.

6. A driving apparatus according to claim 5 further including a cabinet having a partition plate therein which divides the cabinet into two chambers, the partition plate having an opening, wherein each of the two chambers defines the cavity of a respective resonator, and said acoustic mass means of each resonator comprising one of an opening, an opening port or a passive vibrating body located on the outer wall of said cabinet, and wherein said vibrator is mounted on the partition plate, said vibrator closing the opening formed in said partition plate, a first surface of said vibrating body facing one of the cavities, and a second surface thereof facing the other cavity.

7. A driving apparatus according to claim 6, wherein said vibrator is a dynamic electro-acoustic transducer.

8. A driving apparatus for driving an electro-acoustic transducer comprising a driving circuit for providing a driving signal including audio frequencies to the transducer, wherein the output impedance of the driving apparatus near at least a resonance frequency associated with a sound pressure among resonance frequencies in the state of actual use of said transducer is set to be negative, and the output impedance of the driving apparatus in a frequency range in which the influence of non-motional impedance of said transducer on sound quality is not negligible is set to be 0 or positive.

9. A combined speaker and amplifier system comprising:

a speaker including a cabinet having an outer wall and an internal volume, a partition dividing the internal volume into at least first and second chambers, the partition having an opening, a first opening in the cabinet outer wall communicating with the first chamber, a second opening in the cabinet wall communicating with the second chamber, and a vibrator located in the opening of the partition, the chambers defining first and second resonators both of which are driven by the vibrator, the speaker including a plurality of resonance points; and an amplifier providing a drive signal for driving the speaker, the amplifier having an output impedance which is negative at at least one of the resonance points and having different values of output impedance at at least two of of the resonance points.

10. A combined speaker and amplifier system comprising:

a speaker including a cabinet and a vibrator having an inherent internal impedance, the speaker being capable of reproducing sounds in a relatively low frequency audio range and a relatively high frequency audio range; and an amplifier for providing a drive signal to drive the speaker, the amplifier having an output impedance which is negative in the low frequency range and zero or positive in the high frequency range.

11. The system of claim 10, wherein the amplifier includes frequency dependent feedback means, coupled between the speaker and an input of the ampflier, for controlling the output impedance of the amplifier.

12. The system of claim 11, wherein the feedback means includes first control means for causing the amplifier to have a negative impedance in the low frequency range and a second control means for causing the amplifier to have a zero or positive impedance in the high frequency range.

13. A combined speaker and amplifier system comprising:

a speaker including a cabinet defining a cavity and having an outer wall, a vibrator located in a first opening in the outer wall of the cabinet, and acoustic mass means located at a second opening in the outer wall of the cabinet for radiating acoustic waves to the outside of the cabinet in response to resonance with cavity caused by the vibrator, the speaker having at least first and second resonance frequencies within an audio frequency range; and an amplifier for providing a drive signal to the speaker, the amplifier having an output impedance which is a first value at the first resonance frequency and a second value different from the first value at the second resonance frequency, at least one of the first and second values being negative.

14. A system as in claim 13, wherein the amplifier includes feedback means coupled between the speaker and an input to the amplifier to provide feedback to the amplifier to control the first and second output impedance values.

15. A system as in claim 14, wherein the feedback means provides different amounts of feedback at the first and second frequencies.

16. A system as in claim 14, wherein the amplifier includes an amplifying section and wherein the amplifying section has different gain at the first and second frequencies.

17. A system as in claim 13, wherein both the first and second values of output impedance are negative.

18. A system as in claim 13, wherein the first value is negative and the second value is positive.

19. The system of claim 9, wherein the cabinet includes first and second ports extending outwardly from the cabinet outer wall at the first and second openings, respectively.

* * * * *